US008069499B2

(12) United States Patent
Isobe

(10) Patent No.: US 8,069,499 B2
(45) Date of Patent: Dec. 6, 2011

(54) HELMET SHIELD ATTACHING MECHANISM, AND HELMET ATTACHED WITH THE SAME

(75) Inventor: Eiji Isobe, Abiko (JP)

(73) Assignee: Shoei Co., Ltd., Tokyo (JP)

( * ) Notice: Subject to any disclaimer, the term of this patent is extended or adjusted under 35 U.S.C. 154(b) by 1236 days.

(21) Appl. No.: 11/799,935

(22) Filed: May 3, 2007

(65) Prior Publication Data

US 2011/0094019 A1 Apr. 28, 2011

(30) Foreign Application Priority Data

May 15, 2006 (JP) ..... 2006-135211

(51) Int. Cl.
*A42B 1/08* (2006.01)

(52) U.S. Cl. ..... 2/424; 2/15; 2/422

(58) Field of Classification Search ..... 2/424, 422, 2/15, 12, 425, 9, 6.1, 6.2, 6.3, 6.5, 6.7
See application file for complete search history.

(56) References Cited

U.S. PATENT DOCUMENTS

| | | | |
|---|---|---|---|
| 3,127,615 | A | 4/1964 | Aileo |
| 3,820,163 | A | 6/1974 | Rappleyea |
| 4,404,690 | A | 9/1983 | Farquharson |
| 4,796,309 | A | 1/1989 | Nava |
| 4,916,759 | A | 4/1990 | Arai |
| 5,012,533 | A | 5/1991 | Raffler |
| 5,088,129 | A | 2/1992 | Kamata |
| 5,272,773 | A | 12/1993 | Kamata |
| 5,815,847 | A | 10/1998 | Holden, Jr. |
| 5,953,761 | A | 9/1999 | Jurga et al. |
| 6,159,324 | A | 12/2000 | Watters et al. |
| 6,185,753 | B1 | 2/2001 | Arai |
| 6,202,223 | B1 | 3/2001 | Chartrand |
| 6,253,386 | B1 | 7/2001 | Gafforio |
| 6,256,797 | B1 | 7/2001 | Nemoto et al. |
| 6,279,172 | B1 | 8/2001 | Epperson et al. |
| 6,292,953 | B1 | 9/2001 | Beautz |
| 6,499,147 | B2 | 12/2002 | Schiebl et al. |
| 6,557,184 | B2 | 5/2003 | Gafforio |
| 6,961,963 | B2 | 11/2005 | Rosie |
| 7,207,071 | B2 | 4/2007 | Pierce |

(Continued)

FOREIGN PATENT DOCUMENTS

EP 0 797 935 A1 10/1997

(Continued)

*Primary Examiner* — Gary L Welch
*Assistant Examiner* — Andrew W Collins
(74) *Attorney, Agent, or Firm* — Smith Gambrell & Russell LLP

(57) ABSTRACT

A helmet shield attaching mechanism with which when raising a shield, the shield and/or an anti-fogging auxiliary shield will not catch on a window opening rim member for a head protecting body, in spite that the operation of raising the shield in a fully-closed state is comparatively simple and that the mechanism has a comparatively simple structure. The helmet shield attaching mechanism includes a stationary base member fixing to the head protecting body, a movable base member attaching to the stationary base member so as to be movable forward and backward with respect to the stationary base member, and the shield which is pivotally supported by the movable base member. When a substantially upward force acts on the shield which is in a fully-closed state, at least one cam follower provided to the shield or stationary base member relatively follows at least one cam surface formed on the stationary base member or shield, to move the shield forward substantially to the front side.

4 Claims, 22 Drawing Sheets

U.S. PATENT DOCUMENTS

| | | | | |
|---|---|---|---|---|
| 7,426,761 | B2 | 9/2008 | Tomcany et al. | |
| 2001/0034895 | A1 | 11/2001 | Ikeda | |
| 2002/0007508 | A1 | 1/2002 | Grepper et al. | |
| 2002/0035748 | A1 | 3/2002 | Racine | |
| 2002/0189005 | A1* | 12/2002 | Taniuchi | 2/424 |
| 2003/0051289 | A1 | 3/2003 | Gafforio et al. | |
| 2003/0074722 | A1* | 4/2003 | Lee | 2/424 |
| 2003/0088907 | A1 | 5/2003 | Gafforio et al. | |
| 2003/0182716 | A1* | 10/2003 | Wu | 2/424 |
| 2003/0196255 | A1* | 10/2003 | Arai | 2/424 |
| 2004/0034903 | A1 | 2/2004 | Blair | |
| 2006/0117467 | A1* | 6/2006 | Choi et al. | 2/424 |
| 2008/0289085 | A1 | 11/2008 | Bryant et al. | |
| 2009/0031483 | A1 | 2/2009 | Wallerberger | |
| 2009/0158506 | A1 | 6/2009 | Thompson et al. | |
| 2010/0095438 | A1 | 4/2010 | Moelker | |

FOREIGN PATENT DOCUMENTS

| | | | |
|---|---|---|---|
| EP | 0 879 566 | A2 | 11/1998 |
| EP | 1 293 138 | A1 | 3/2003 |
| EP | 1 854 368 | A2 | 11/2007 |
| JP | 62 69812 | | 3/1987 |
| JP | 09 119014 | | 5/1997 |
| JP | 11-247018 | | 9/1999 |
| JP | 2000 160424 | | 6/2000 |
| JP | 2001 115327 | | 4/2001 |
| JP | 2002-138320 | | 5/2002 |
| JP | 2005 054300 | A | 3/2005 |

* cited by examiner

HELMET SHIELD ATTACHING MECHANISM, AND HELMET ATTACHED WITH THE SAME

TECHNICAL FIELD

The present invention relates to a helmet shield attaching mechanism comprising a shield attaching base member attaching to a head protecting body, and a shield, a portion near one of the right and left ends of which pivotally attaches to the shield attaching base member, the shield attaching base member comprising a stationary base member fixing to the head protecting body, and a movable base member attaching to the stationary base member so as to be linearly reciprocally movable with respect to the stationary base member, and the shield being pivotally supported by the movable base member.

The present invention also relates to a helmet comprising a left shield attaching mechanism provided to a left side of a head protecting body to pivotally support a portion of a shield near a left end thereof onto the head protecting body, and a right shield attaching mechanism provided to a right side of the head protecting body to pivotally support a portion of the shield near a right end thereof onto the head protecting body, among the left shield attaching mechanism and said right shield attaching mechanism, at least one shield attaching mechanism comprising a shield attaching base member attaching to the head protecting body, and the shield, the portion near one of the right and left ends of which pivotally attaches to the shield attaching base member, the shield attaching base member comprising a stationary base member fixing to the head protecting body, and a movable, base member attaching to the stationary base member so as to be linearly reciprocally movable with respect to the stationary base member, and the shield being pivotally supported by the movable base member.

BACKGROUND OF THE INVENTION

In a full-face-type helmet or the like, an anti-fogging auxiliary shield may attach to an original shield. Such an auxiliary shield removably attaches to the inner surface of the original shield so as to form a small gap with the original shield. When using a helmet in which such an anti-fogging auxiliary shield attaches to an original shield, if the axial supports on the right and left sides of the head protecting body of the helmet merely axially support portions of the original shield near the right and left ends, the following inconveniences arise. More specifically, when pivoting the original shield upward about the axial supports on the right and left sides as the pivot center, the anti-fogging auxiliary shield may catch on a window opening rim member attaching to the window opening of the head protecting body to interfere with the original shield and anti-fogging auxiliary shield from smoothly moving upward. When raising an original shield to which no anti-fogging auxiliary shield attaches, the original shield may catch on a window opening rim member or the like more or less to interfere with the original shield from smoothly moving upward.

EP 1 293 138 A1 discloses a helmet shield attaching mechanism as described in the beginning. In the shield attaching mechanism of EP 1 293 138 A1, a fully-closed shield (that is, the original shield) is pulled forward first and is then raised. In this case, as the fully-closed shield is accommodated in a shield accommodating recess formed in a head protecting body, it can be moved upward only after pulling it forward. For this reason, in the shield attaching mechanism of EP 1 293 138 A1, as the shield is pulled forward first and is then raised, when raising the fully-closed shield, the shield can move upward without catching on a window opening rim member or the like.

In the case of the shield attaching mechanism of EP 1 293 138 A1 having the above arrangement, when raising the shield, the helmet wearer must hold the shield with his fingers, move his fingers forward to pull the shield forward, and then move his fingers upward to pull the shield upward. In contrast to this, if applying the shield attaching mechanism of EP 1 293 138 A1 to an ordinary full-face-type helmet (that is, a full-face-type helmet not having a shield accommodating recess), when raising the fully-closed shield, the helmet wearer can raise it only by holding the shield with his fingers and then moving his fingers upward. In such an ordinary full-face-type helmet, when an anti-fogging auxiliary shield attaches to the inner surface of the original shield, unless the helmet wearer performs two-step operation of pulling the shield forward and then upward, the auxiliary shield may catch on the window opening rim member. If the helmet wearer erroneously performs only one-step operation (that is, the operation of only pulling the shield upward), the original shield cannot smoothly move upward. To smoothly move the original shield upward, the two-step operation as described above is necessary, and accordingly the operation of raising the fully-closed shield becomes cumbersome.

SUMMARY OF THE INVENTION

The present invention is aimed at effectively correcting the above drawbacks of the shield attaching mechanism of EP 1 293 138 A1 with a comparatively simple arrangement. It is an object of the present invention to provide a helmet shield attaching mechanism with which even if an anti-fogging auxiliary shield may or may not attach to the inner surface of a shield, when raising the shield which is in the substantially fully-closed state, the shield or anti-fogging auxiliary shield can move upward without catching on a window opening rim member for a head protecting body or the like.

According to the first aspect of the present invention, there is provided a helmet shield attaching mechanism comprising a shield attaching base member attaching to a head protecting body, and a shield, a portion near one of right and left ends of which pivotally attaches to the shield attaching base member, the shield attaching base member comprising a stationary base member fixing to the head protecting body, and a movable base member attaching to the stationary base member so as to be linearly reciprocally movable with respect to the stationary base member, and the shield being pivotally supported by the movable base member, wherein any one of the shield and the stationary base member is provided with at least one cam surface, the remaining one of the shield and the stationary base member is provided with at least one cam follower to be able to abut against at least one cam surface, and when a substantially upward force acts on the shield which is in a substantially fully-closed state, the cam follower relatively follows the cam surface to move the shield, together with the movable base member, forward substantially to a front side with respect to the stationary base member.

According to the second aspect of the present invention, there is provided a helmet comprising a left shield attaching mechanism provided to a left side of a head protecting body to pivotally support a portion of a shield near a left end thereof onto the head protecting body, and a right shield attaching mechanism provided to a right side of the head protecting body to pivotally support a portion of the shield near a right end thereof onto the head protecting body, among the left shield attaching mechanism and the right shield attaching mechanism, at least one shield attaching mechanism comprising a shield attaching base member attaching to the head protecting body, and the shield, the portion near one of the right and left ends of which pivotally attaches to the shield attaching base member, the shield attaching base member comprising a stationary base member fixing to the head protecting body, and a movable base member attaching to the stationary base member so as to be linearly reciprocally movable with respect to the stationary base member, and the shield being pivotally supported by the movable base member, wherein any one of the shield and the stationary base member is provided with at least one cam surface, and the remaining one of the shield and the stationary base member is provided with at least one cam follower to be able to abut against at least one cam surface, and when a substantially upward force acts on the shield which is in a substantially fully-closed state, the cam follower relatively follows the cam surface to move the shield, together with the movable base member, forward substantially to a front side with respect to the stationary base member. In this case, at least one shield attaching mechanism may comprise the left shield attaching mechanism and the right shield attaching mechanism.

According to the first and second aspects of the present invention, even if an anti-fogging auxiliary shield may or may not attach to the inner surface of a shield, when raising the shield which is in the substantially fully-closed state, the shield or anti-fogging auxiliary shield can move upward without catching on a window opening rim member for the head protecting body or the like. In spite that the shield attaching mechanism has a comparatively simple structure, the shield can be pulled forward and then raised by merely pulling upward the shield which is in the substantially fully-closed state. Thus, the operation of raising the shield which is at a substantially fully-closed position is comparatively simple and comparatively reliable, and can be free from erroneous operation.

In the first and second aspects of the present invention, generally, from the viewpoint of practicability, a distance of forward movement of the shield, together with the movable base member, substantially to the front side with respect to the stationary base member (in other words, a distance through which the movable base member moves forward to the front side with respect to the stationary base member) preferably falls within a range of 1 mm to 8 mm, more preferably within a range of 1.5 mm to 6 mm and further preferably within a range of 2 mm to 4 mm. In the first and second aspects of the present invention, the movable base member can linearly reciprocally move with respect to the stationary base member forward and backward in a substantially back-and-forth direction.

In the first and second aspects of the present invention, according to the first mode, at least one cam surface may comprise one cam surface, and at least one cam follower may comprise one cam follower. In this case, the cam surface may be formed on the shield, and the cam follower may be provided to the stationary base member. According to the first mode of the first and second aspects of the present invention, the structure of the shield attaching mechanism can be further simplified.

In the first and second aspects of the present invention, according to the second mode, at least one cam surface may comprise two cam surfaces, and at least one cam follower may comprise two cam followers. In this case, the shield may be provided with a first cam surface among the two cam surfaces and a second cam follower among the two cam followers, and the stationary base member may be provided with a second cam surface among the two cam surfaces and a first cam follower among the two cam followers. According to the second mode of the first and second aspects of the present invention, as the stationary base member can press the shield to the front side through two portions, the shield can be pushed out to the front side more smoothly.

According to the first and second aspects of the present invention, in the third mode, preferably, the shield attaching mechanism further comprises at least one elastic biasing means capable of elastically biasing the movable base member toward the stationary base member substantially to a rear side, at least one stopper provided to the stationary base member, and at least one stopped portion provided to the movable base member, wherein when the elastic biasing means elastically biases the movable base member and holds the movable base member at a backward position, at least one stopped portion abuts against at least one stopper. In this case, at least one elastic biasing means may comprise two elastic biasing means. The elastic biasing means may comprise a compression coil spring. At least one stopper may comprise two stoppers, and at least one stopped portion may comprise two stopped portions. According to the third mode of the first and second aspects of the present invention, the movable base member can be held at the backward position with respect to the stationary base member comparatively reliably with a comparatively simple structure.

In the first and second aspects of the present invention, according to the fourth mode, preferably, a shield attaching/removing manipulation member which is manipulated to remove the shield from the movable base member is disposed to be reciprocal with respect to the movable base member, and the shield is pivoted forward to a substantially full-open state and thereafter the shield attaching/removing manipulation member is moved forward to set the shield in a removable state. In this case, the shield attaching/removing manipulation member may be reciprocally pivotal about an axial support as the fulcrum. According to the fourth mode of the first and second aspects of the present invention, the shield can be removed comparatively easily with a comparatively simple structure.

In the first and second aspects of the present invention, according to the fifth mode, when the shield is pivoted forward to the substantially full-open state, preferably, the stopped portion abuts against the stopper. According to the fifth mode of the first and second aspects of the present invention, the shield which is substantially in the full-open state can be prevented from being fluttered by the traveling wind more or less. A combination of the arrangement of the fifth mode and the arrangement of the fourth mode can remove the shield comparatively easily and comparatively reliably.

According to the first and second aspects of the present invention, in the sixth mode, preferably, a reciprocal shield lock manipulation member serving also as a shield slightly-opening manipulation member, which is capable of setting the shield in a slightly-open state and in a locked state at a substantially fully-closed position, is disposed to be reciprocal with respect to the movable base member, when moving the shield lock manipulation member serving also as the shield slightly-opening manipulation member forward in a first forward direction from a neutral position, the shield can be set in a slightly-open state, and when moving the shield lock manipulation member serving also as the shield slightly-opening manipulation member forward in a second forward direction from the neutral position, the shield can be set in a locked state. In this case, the shield lock manipulation member serving also as the shield slightly-opening manipulation member can be reciprocally pivotal about an axial support as the fulcrum. According to the sixth mode of the first and second aspects of the present invention, a common manipulation member can manipulate the shield to the slightly-open state and to the locked state comparatively easily in spite of a comparatively simple structure.

The above and other objects, features and advantages of the present invention will become readily apparent from the following detailed description thereof which is to be read in connection with the accompanying drawings.

DETAILED DESCRIPTION OF THE INVENTION

The first and second embodiments in which the present invention is applied to a shield attaching mechanism for a full-face-type helmet will be described in "A. First Embodiment" and "B. Second Embodiment" with reference to the accompanying drawings.

A. First Embodiment

The first embodiment of the present invention will be described in "1. Schematic Arrangement of Helmet as a Whole", "2. Arrangement of Shield Attaching Mechanism" and "3. Operation of Shield Attaching Mechanism" with reference to FIGS. 1 to 14.

1. Schematic Arrangement of Helmet as a Whole

Figure 1:
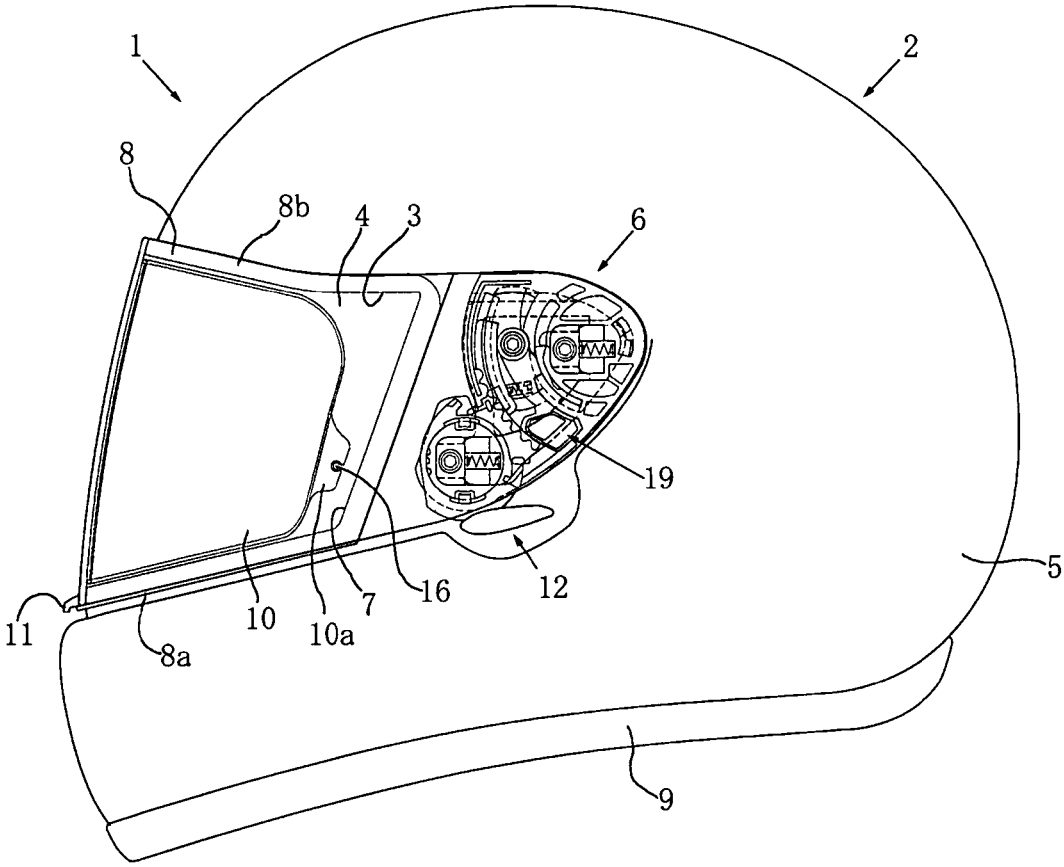
FIG. 1 is a schematic left side view of a helmet as a whole, in which a shield is in a fully-closed state, according to the first embodiment in which the present invention is applied to a full-face-type helmet shield attaching mechanism.

As shown in FIG. 1, a full-face-type helmet 1 comprises a full-face-type head protecting body 2 to be worn on the head of a helmet wearer such as a motorcycle rider, an original shield (in other words, a main shield) 4 which can open/close a window opening 3 formed in the front surface of the full-face-type head protecting body 2 so as to oppose a portion between the forehead and chin (that is, the central portion of the face) of the helmet wearer, and a pair of right and left chin straps (not shown) attaching to the inner side of the head protecting body 2. Of the head protecting body 2, each of those portions which oppose the chin, forehead and the like of the helmet wearer is provided with one or a plurality of ventilators (not shown), where necessary, to ventilate air in the full-face-type head protecting body 2. The shield 4 is provided to the helmet 1 to serve as a windshield. Where necessary, the shield 4 may be colored not to particularly interfere with the translucence so it can also serve as a sun visor (that is, a visor), and may be made of a transparent or translucent hard material such as polycarbonate or another synthetic resin. A pair of right and left shield attaching mechanisms 6 attach portions of the shield 4 near the right and left sides to an outer shell 5 which constitutes the outer wall of the head protecting body 2.

Figure 2:
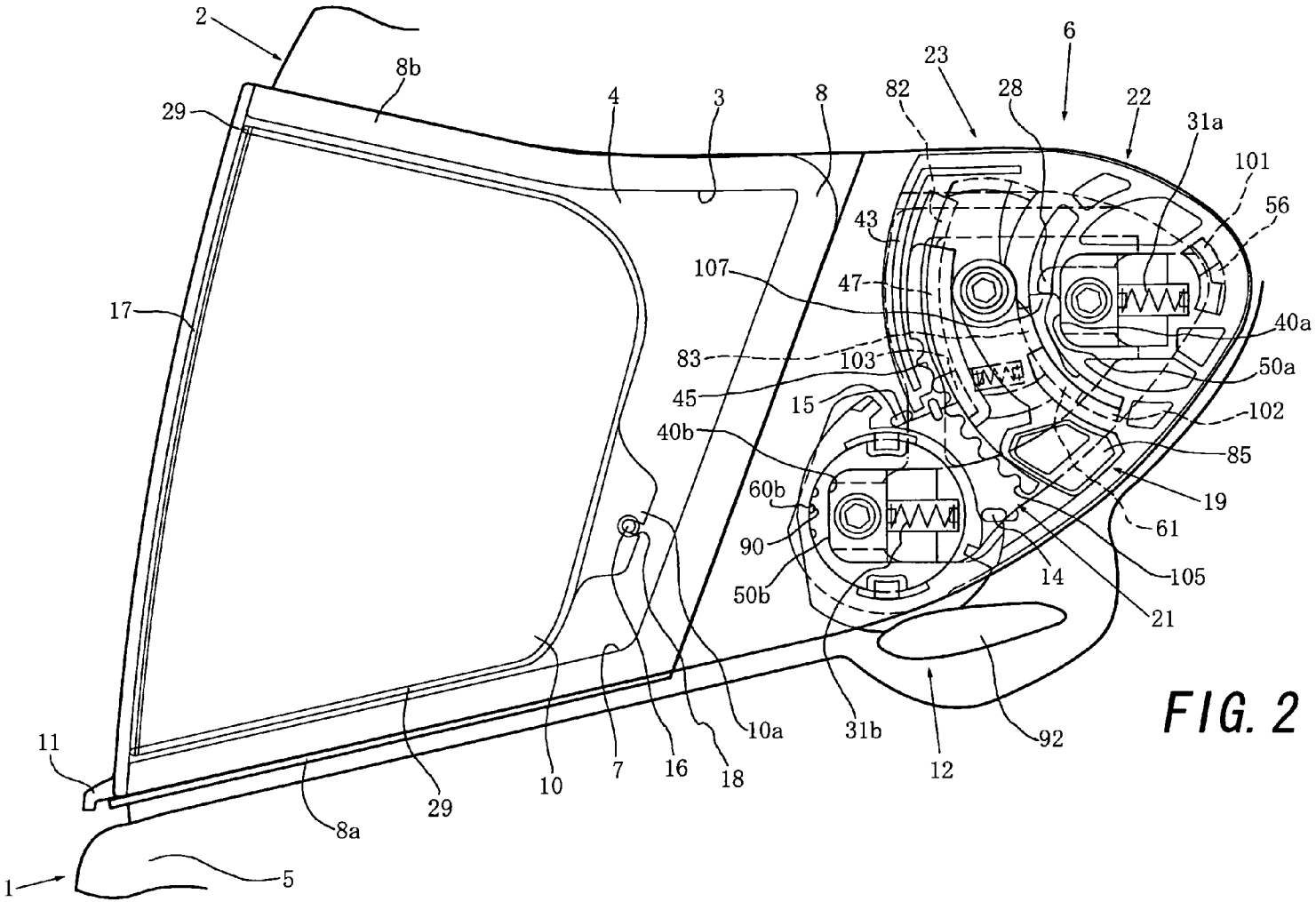
FIG. 2 is an enlarged left side view of the main part of the helmet to show the shield attaching mechanism in FIG. 1.

As shown in FIGS. 1 and 2, an anti-fogging auxiliary shield 10 which can be made of a transparent or translucent hard material such as polycarbonate or another synthetic resin can removably attach to the inner surface of the shield 4 to form a small gap 17 with the shield 4. To attach the shield 10, as shown in FIG. 2, a pair of right and left engaging pins 16 respectively having engaging ring-like grooves attach and fix to those portions of the right and left sides of the inner surface of the shield 4, which are slightly below the central portions, by screwing or the like. A pair of right and left tongue pieces

10*a* project from those portions of the right and left ends of the anti-fogging auxiliary shield 10 which are slightly below the central portions in a substantially vertical direction. The pair of right and left tongue pieces 10*a* respectively have a pair of right and left engaging slits 18 which are open backwardly. The pair of right and left engaging pins 16 respectively fit in the pair of right and left engaging slits 18 to attach the anti-fogging auxiliary shield 10 to the inner surface of the shield 4. A packing projecting ridge 29 made of an elastic material such as silicone rubber forms a loop along the outer periphery of a region of the outer surface of the auxiliary shield 10 except for the pair of right and left tongue pieces 10*a*. Thus, the anti-fogging auxiliary shield 10 maintains the small gap 17 with the shield 4, and holds the gap 17 airtightly.

Figure 10:
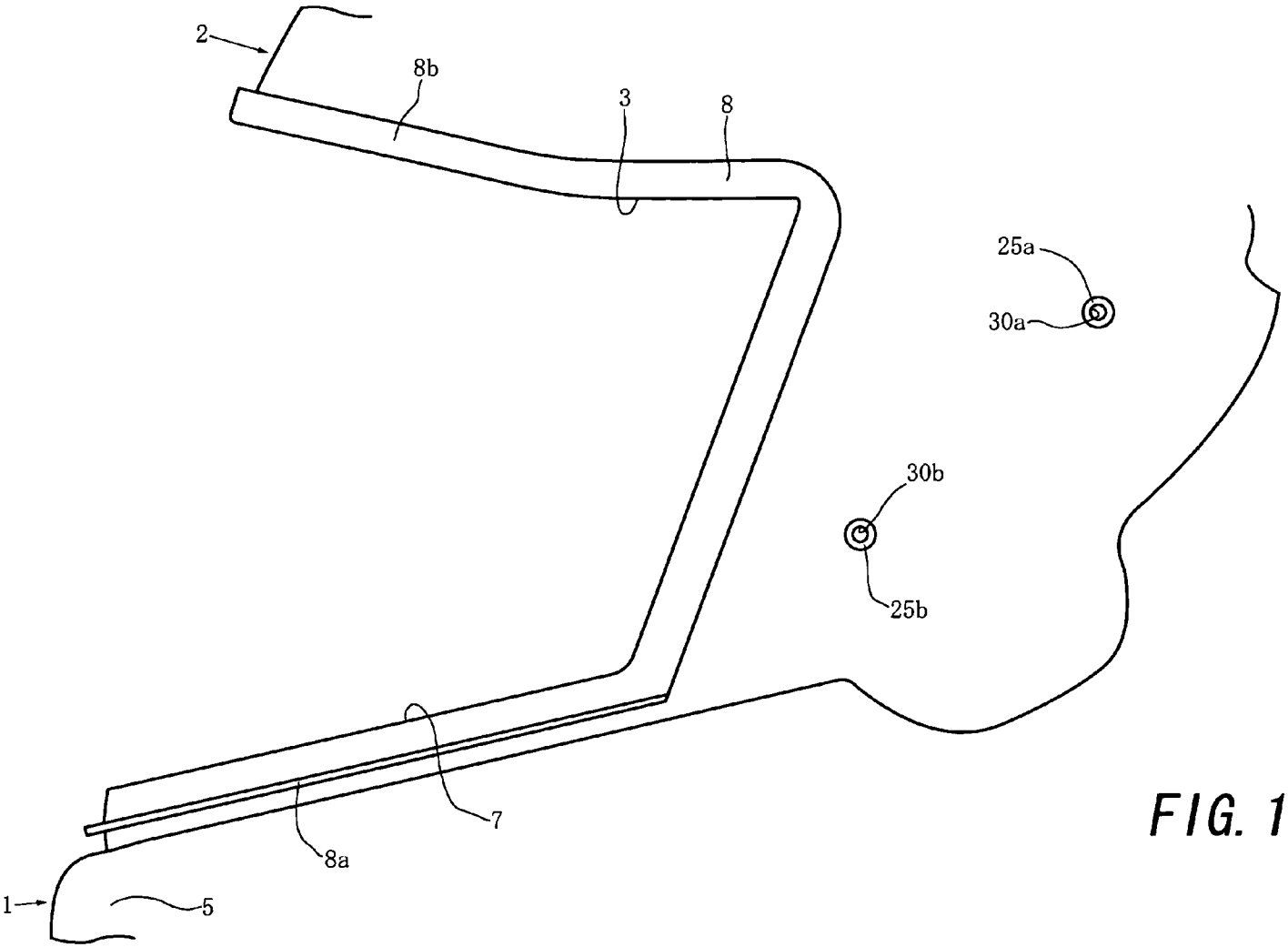
FIG. 10 is an enlarged left side view, similar to FIG. 2, of the helmet before the shield attaching mechanism is built into the head protecting body.

As is conventionally known, the outer shell 5 can be made of a strong hard material such as FRP or another synthetic resin. As shown in FIG. 1, a window opening rim member 8 having a substantially U- or E-shaped section attaches to substantially the entire periphery of a window opening 7, which is formed in the outer shell 5 to form the window opening 3 of the full-face-type head protecting body 2, by, e.g., adhesion with an adhesive, double-sided adhesive tape, or the like, as has been conventionally known. As shown in FIGS. 1 and 10, the lower end of the shield 4 which is fully closed abuts against a projecting ridge 8*a* which substantially horizontally continues at the lower end of the window opening rim member 8 along the lower end of the window opening 7. A lower end rim member 9 having a substantially U-shaped section or the like attaches to substantially the entire periphery of the lower end of the outer shell 5 by, e.g., adhesion with an adhesive or double-sided adhesive tape, or the like. As is conventionally known, the window opening rim member 8 can be made of synthetic rubber or another flexible elastic material. As is conventionally known, the lower end rim member 9 can be made of a soft material such as foamed vinyl chloride, synthetic rubber, or another soft synthetic resin. In FIG. 1, reference numeral 11 denotes a finger rest which is integrally provided to the lower end of substantially the central portion of the shield 4. The helmet wearer places his fingers on the finger rest 11 when reciprocally pivoting the shield 4 upward and downward.

Figure 9:
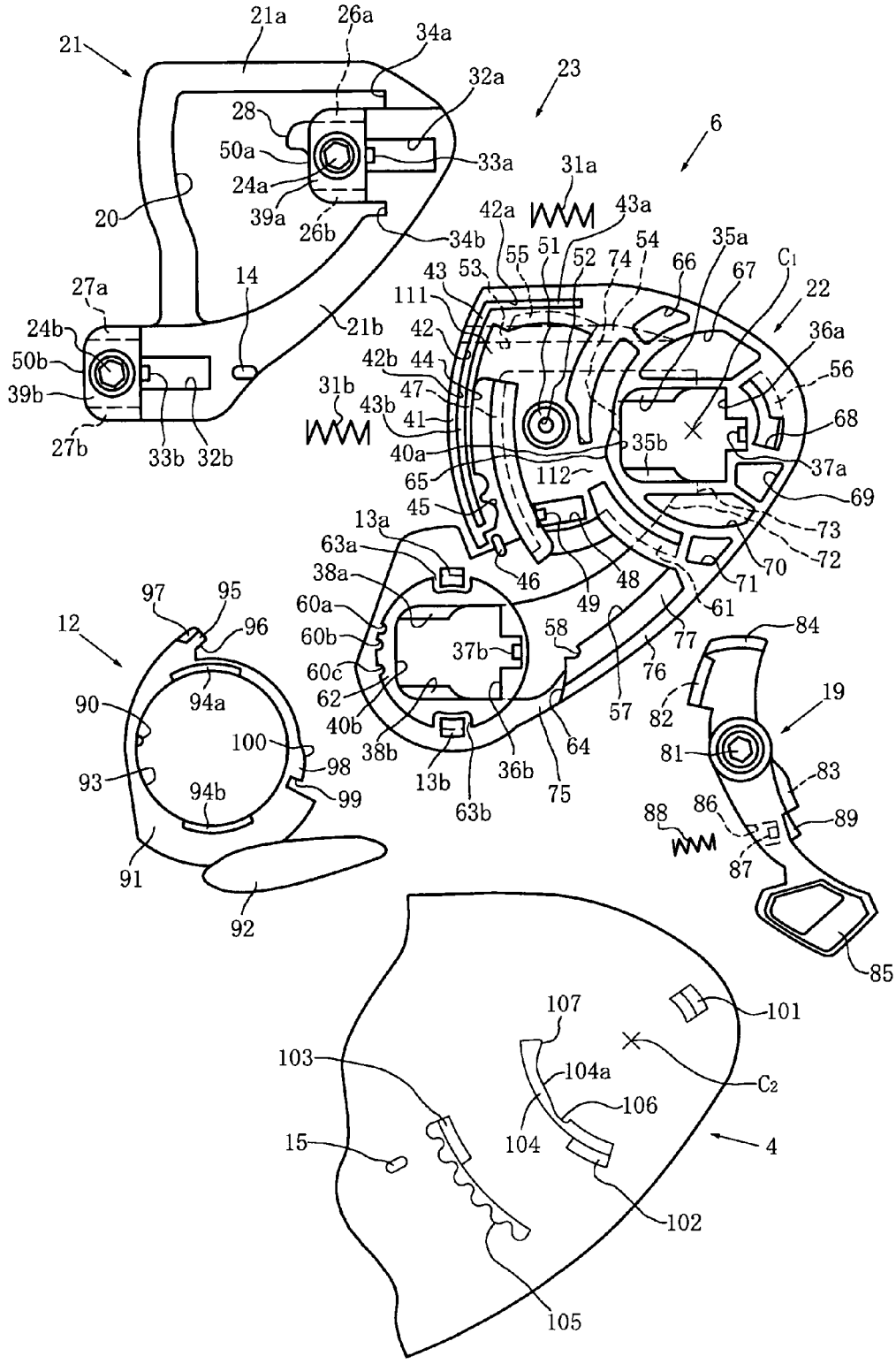
FIG. 9 is an exploded front view of the shield attaching mechanism in FIG. 1.

The right (the left side to the front surface of the helmet) shield attaching mechanism 6 is axi-symmetrical with the left shield attaching mechanism 6 except for a respect that is partly different from the left shield attaching mechanism 6. The difference is that, unlike in the left shield attaching mechanism 6, the right shield attaching mechanism 6 is not provided with a shield lock manipulation lever 12, which is shown in FIG. 9 and will be described later, to serve as a shield slightly-opening manipulation lever, a pair of guide projections 13*a* and 13*b* to guide the manipulation lever 12, and the like, because a shield slightly-opening projection 14 and shield lock projection 15 are not particularly necessary. Hence, in the following description, a description on the right shield attaching mechanism 6 will not be repeated, and only the left shield attaching mechanism 6 will be described.

2. Arrangement of Shield Attaching Mechanism

As shown in FIG. 9, the left shield attaching mechanism 6 includes members described in the following items (a) to (d):

(a) a shield attaching base member 23 which includes a stationary base member 21 and movable base member 22 and is used to attach the shield 4 to the head protecting body 2;

(b) a shield attaching/removing manipulation lever 19 which is manipulated when removing the shield 4 from the movable base member 22 and, in some cases, when attaching the shield 4 to the movable base member 22;

(c) the shield lock manipulation lever 12, serving also as the shield slightly-opening manipulation lever, which is manipulated when slightly opening the shield 4 which is fully closed, and when locking the shield 4 at the fully-closed state; and (d) the shield 4, a portion near the left end of which can removably attach to the movable base member 22.

Hence, the arrangement of the left shield attaching mechanism 6 will be described below in "(1) stationary base member", "(2) movable base member", "(3) shield attaching/removing manipulation lever", "(4) shield lock manipulation lever serving also as shield slightly-opening manipulation lever", "(5) shield" and "(6) assembly of shield attaching mechanism" with reference to FIGS. 1 to 14. Each of the stationary base member 21, movable base member 22 and manipulation levers 19 and 12 is made of, e.g., a synthetic resin such as a polyacetal resin.

(1) Stationary Base Member

Figure 11:
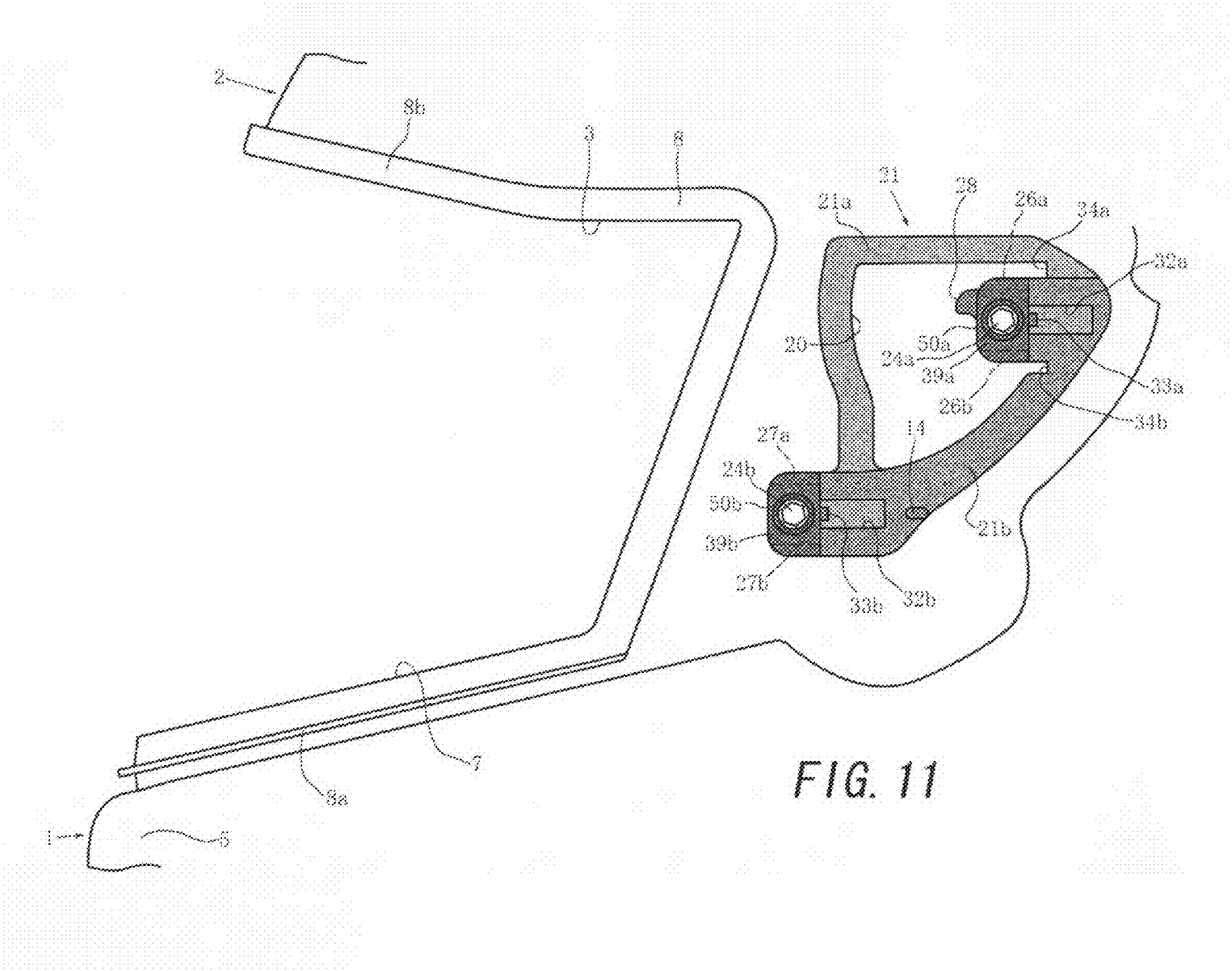
FIG. 11 is an enlarged left side view, similar to FIG. 10, of the helmet with the stationary base member of the shield attaching mechanism being built into the head protecting body.

As shown in FIGS. 9 and 11, the stationary base member 21 of the shield attaching base member 23 forms an almost right-angled triangular frame structure having a large central through hole 20. The stationary base member 21 which is expressed by halftone in FIG. 11 forms an almost plate-like shape except that it has the large central through hole 20. A pair of male screw members 24*a* and 24*b* inserted in upper and lower screw insertion holes (not shown) attach and fix the stationary base member 21, as shown in FIG. 11, to the full-face-type head protecting body 2 shown in FIG. 10. As shown in FIG. 10, a pair of upper and lower female screw members 25*a* and 25*b* are buried in and fixed to that portion of the outer shell 5 which is behind the window opening 7 (that is, the right side in FIG. 10). To attach and fix the stationary base member 21, the pair of male screw members 24*a* and 24*b* are screwed and fixed in screw holes 30*a* and 30*b* of the pair of female screw members 25*a* and 25*b* from the outer surface of the stationary base member 21. The inner surface of the stationary base member 21 preferably forms an arcuate shape which slightly rises toward the outer surface so as to substantially coincide with the arcuate shape of the outer surface of the outer shell 5. The movable base member 22 also preferably forms such an arcuate shape.

As shown in FIG. 9, the stationary base member 21 has a pair of upper and lower guide grooves 26*a* and 26*b* and a pair of upper and lower guide grooves 27*a* and 27*b*, each having a substantially U-shaped section, at upper and lower sides of the pair of upper and lower male screw members 24*a* and 24*b* (in other words, the screw insertion holes where the pair of upper and lower male screw members 24*a* and 24*b* are inserted). The direction of depth of each of the upper guide grooves 26*a* and 27*a* is substantially downward from above. The direction of depth of each of the lower guide grooves 26*b* and 27*b* is substantially upward from below. The stationary base member 21 has a cam projection 28, serving as a cam follower, at a portion in front of the upper male screw member 24*a*. The stationary base member 21 has a pair of upper and lower spring accommodating recesses 32*a* and 32*b*, at portions on its outer surface behind the pair of upper and lower male screw members 24*a* and 24*b*, to accommodate a pair of upper and lower compression coil springs 31*a* and 31*b*. Spring engaging projections 33*a* and 33*b* are formed on the front side wall portions of the pair of upper and lower recesses 32*a* and 32*b*.

The shield slightly-opening projection 14 which serves as a cam follower projects from the outer surface of the stationary base member 21 at a portion behind the lower spring accommodating recess 32*b*. The stationary base member 21 has a pair of upper and lower notches 34*a* and 34*b* at portions near the upper and lower sides of the pair of upper and lower guide grooves 26*a* and 26*b*. The pair of upper and lower notches 34*a* and 34*b* serve as relieves when a pair of upper and lower guided projecting ridges 35*a* and 35*b* of the movable base member 22 shown in FIG. 9 move backward to the backward positions shown in FIG. 12.

(2) Movable Base Member

Figure 12:
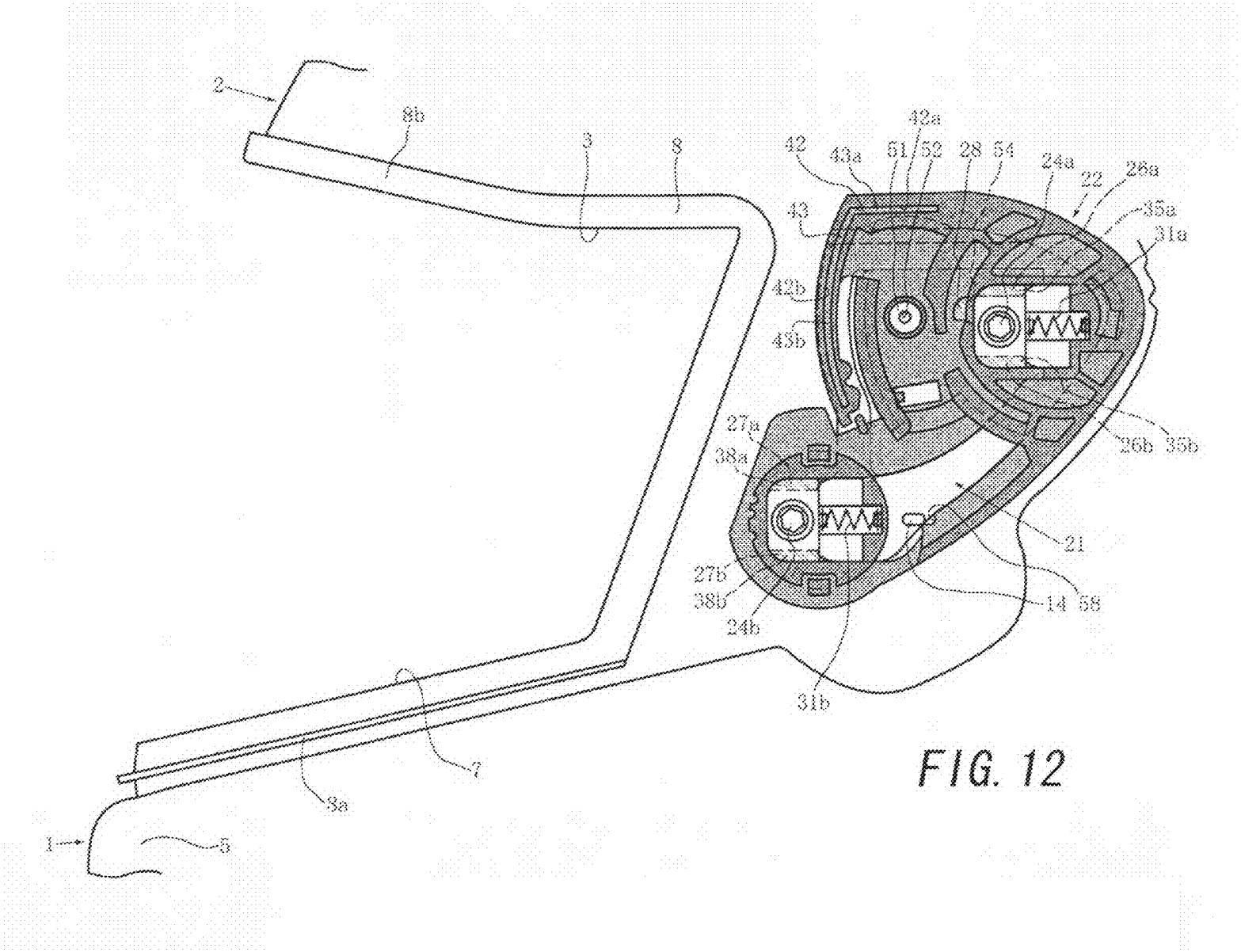
FIG. 12 is an enlarged left side view, similar to FIG. 10, of the helmet with the stationary base member and movable base member of the shield attaching mechanism being built into the head protecting body.

As shown in FIGS. 9 and 12, the movable base member 22 of the shield attaching base member 23 has a perimeter larger than that of the stationary base member 21 by one level, and forms a substantially plate-like shape larger than the stationary base member 21. The movable base member 22 expressed by halftone in FIG. 12 has a pair of upper and lower through holes 36*a* and 36*b*, as shown in FIG. 9. As shown in FIG. 12, a high-level portion 39*a*, where the upper pair of upper and lower guide grooves 26*a* and 26*b* of the stationary base member 21 are formed, can be inserted in the upper through hole 36*a*. A high-level portion 39*b*, where the lower pair of upper and lower guide grooves 27*a* and 27*b* of the stationary base member 21 are formed, can be inserted in the lower through hole 36*b*. The pair of upper and lower guided projecting ridges 35*a* and 35*b* are respectively formed on the upper and lower side wall portions of the circumferential wall portion of the upper through hole 36*a*. A spring engaging projection 37*a* to engage with the upper compression coil spring 31*a* is formed on the rear side wall portion of the circumferential wall portion of the upper through hole 36*a*. A pair of upper and lower guided projecting ridges 38*a* and 38*b* are formed on the upper and lower side wall portions of the circumferential wall portion of the lower through hole 36*b*. A spring engaging projection 37*b* to engage with the lower compression coil spring 31*b* is formed on the rear side wall portion of the circumferential wall portion of the lower through hole 36*b*.

As shown in FIG. 9, the movable base member 22 has an engaging arm (that is, a cantilevered engaging arm) 41 at substantially the central portion of its front end. The engaging arm 41 extends downward from above, and its lower end forms a free end and can flex elastically. The movable base member 22 has an substantially-inverted-L-shaped groove 42 in its outer surface. The substantially-inverted-L-shaped groove 42 extends from near the free end of the engaging arm 41 via the engaging arm 41 to near the upper end of the movable base member 22, and furthermore from the front side to the rear side near the upper end of the movable base member 22. A substantially-inverted-L-shaped leaf spring 43 made of a metal or the like to reinforce the engaging arm 41 is inserted in and fixed to the groove 42. The leaf spring 43 serving as the reinforcing member and made of a metal or the like preferably has substantially the same shape (that is, a substantially-inverted-L shape of substantially the same shape) as that of the groove 42 and a width larger than the depth of the substantially-inverted-L-shaped groove 42, so it can tightly fit in the groove 42. In this case, a first groove portion 42*a* extending in substantially the horizontal direction and a second groove portion 42*b* extending in substantially the vertical direction constitute the groove 42. A first spring portion 43*a* extending in substantially the horizontal direction and a second spring portion 43*b* extending in substantially the vertical direction constitute the leaf spring 43. The first and second spring portions 43*a* and 43*b* are inserted in and fixed to the first and second groove portions 42*a* and 42*b*, respectively. Alternatively, the first groove portion 42*a* and first spring portion 43*a* may be omitted, and only the second groove portion 42*b* and second spring portion 43*b* may respectively constitute the groove 42 and leaf spring 43. Where necessary, the leaf spring 43 serving as the reinforcing member may be replaced by a coil spring made of a metal or the like. In this case, the groove 42 can be made wider to match the thickness of the coil spring. In this case, preferably, the first groove portion 42*a* and first spring portion 43*a* are omitted where necessary, and only the second groove portion 42*b* and second spring portion 43*b* respectively constitute the groove 42 and leaf spring 43.

As shown in FIG. 9, the movable base member 22 has a slit 44, at a portion behind the engaging arm 41, which extends from the proximal end to the free end of the engaging arm 41. The rear end of the engaging arm 41 (in other words, an end that opposes the slit 44) forms a click tooth portion 45 having one or a plurality of (two in the case of FIG. 9) teeth. The movable base member 22 has a stopper 46, which regulates the forward movement of the engaging arm 41 counterclockwise in FIG. 9 so as to oppose the free end of the engaging arm 41 and the proximal portion of the slit 44. The movable base member 22 also has an substantially arcuate first guide 47 along an end behind the slit 44. The first guide 47 is formed by recessing the inner surface of the movable base member 22 along the end behind the slit 44, to have substantially the same length as that of the slit 44. The first guide 47 projects toward the slit 44 to form an eaves structure.

As shown in FIG. 9, the outer surface of the movable base member 22 has a spring accommodating recess 48 behind a portion near the lower end of the first guide 47. A spring engaging projection 49 is formed on the front side wall portion of the recess 48. The movable base member 22 has a screw hole 52, formed by, e.g., burying and fixing a female screw member 51, behind a portion near the upper end of the first guide 47. The inner surface of the movable base member 22 has a ridge groove portion 53, where an upper arm 21*a* of the stationary base member 21 is to be inserted or fitted, to extend substantially horizontally above the screw hole 52. Reference numeral 54 denotes a projecting ridge which extends on the inner surface of the movable base member 22 substantially horizontally to form the ridge groove portion 53.

The movable base member 22 has a substantially arcuate guide 55 to be adjacent to the upper side of the projecting ridge 54. The guide 55 is formed thin as its inner surface is recessed. The movable base member 22 has a substantially arcuate guide slit (not shown) to be adjacent to the inner surface of the lower end of the guide 55. Hence, the guide 55 projects in the planar direction of the movable base member 22 to form an eaves structure. The movable base member 22 has a substantially arcuate second guide 56 at a portion behind the upper through hole 36*a*. The second guide 56 is formed thin as its inner surface is recessed. The movable base member 22 has a substantially arcuate guide slit (not shown) to be adjacent to the inner surface of the upper end of the second guide 56. Hence, the second guide 56 projects in the planar direction of the movable base member 22 to form an eaves structure.

As shown in FIG. 9, an intermediate through hole 57 is formed between the upper through hole 36*a* and lower through hole 36*b*. The side wall portion of the intermediate through hole 57 has a recess 58 to form a relief for the shield slightly-opening projection 14 of the stationary base member 21. A substantially arcuate third guide 61 is formed between the upper through hole 36*a* and intermediate through hole 57. The third guide 61 is formed thin as its inner surface is recessed. The movable base member 22 has a substantially arcuate guide slit (not shown) to be adjacent to the inner surface of that end of the third guide 61 which is on the through hole 36*a* side. Hence, the third guide 61 projects in the planar direction of the movable base member 22 to form an eaves structure. Preferably, the center of the virtual circle of the substantially arcuate first guide 47, the center of the virtual circle of the substantially arcuate second guide 56, and the center of the virtual circle of the substantially arcuate third guide 61 coincides with a substantially common central point $C_1$ shown in FIG. 9.

A substantially annular axial support 62 for the shield lock manipulation lever 12 serving also as the shield slightly-opening manipulation lever projects from the outer surface of the movable base member 22 shown in FIG. 9 so as to surround the lower through hole 36*b*. Three click recesses 60*a*, 60*b* and 60*c* are formed in the outer peripheral portion of the axial support 62. The pair of guide projections 13*a* and 13*b* are respectively disposed in a pair of upper and lower notches 63*a* and 63*b* formed near the outer surface of the axial support 62. Reference numeral 64 denotes a step which is adjacent to the front side of the recess 58. The step 64 extends between a low-level portion 75 located adjacent to the outer side of the axial support 62, and a high-level portion 76 and mid-level portion 77 which are adjacent to the low-level portion 75 through the step 64. Reference numerals 72 and 73 denote steps for an inclined arm 21*b* which extends in the oblique direction in the stationary base member 21. Reference numerals 65, 66, 67, 68, 69, 70 and 71 denote recesses formed in the movable base member 22. The recesses 65 to 71 have substantially the same heights as that of the mid-level portion 77. The movable base member 22 also has a through hole 74 in which the cam follower 28 of the stationary base member 21 is inserted so as to extend through the front side wall portion of the upper through hole 36*a* in the planar direction. The through hole 74 extends substantially along the planar direction of the movable base member 22 so as to allow the upper through hole 36*a* and recess 65 to communicate with each other.

(3) Shield Attaching/Removing Manipulation Lever

Figure 13:
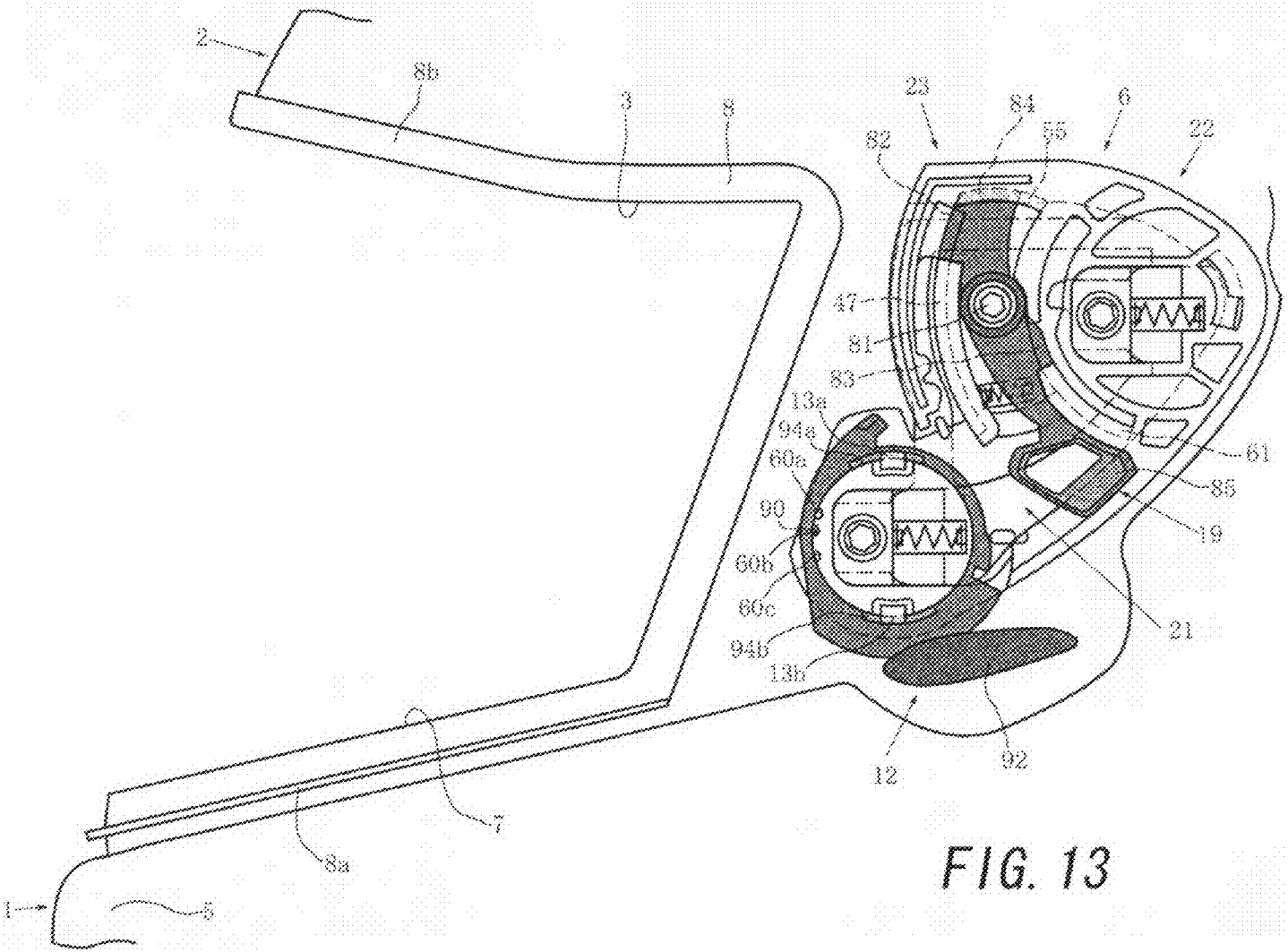
FIG. 13 is an enlarged left side view, similar to FIG. 2, of the helmet from which the shield has been removed.

The shield attaching/removing manipulation lever 19 which serves as the shield attaching/removing manipulation member forms a substantially thin plate-like elongated shape, as shown in FIGS. 9 and 13. The manipulation lever 19 has a screw insertion hole at almost its intermediate portion. A male screw member 81, inserted in the screw insertion hole from the outer surface of the manipulation lever 19, is screwed in and fixed to the screw hole 52 in the movable base member 22, to pivotally attach and fix the manipulation lever 19 to the movable base member 22. In this case, the male screw member 81, the screw insertion hole of the manipulation lever 19 and the screw hole 52 of the movable base member 22 are used to pivotally attach and fix the shield attaching/removing manipulation lever 19 to the movable base member 22. Alternatively, in place of the male screw member 81, the screw insertion hole and the screw hole 52, the manipulation lever 19 may be provided with an axial support member (not shown) which projects on its inner surface and has a screw hole at its distal end and a coming-off preventive head at its proximal end. In this case, the movable base member 22 is provided with a through hole in which the axial support member is pivotally fitted. The distal end of the axial support member is inserted in the through hole from the outer surface of the manipulation lever 19, so the axial support member is pivotally fitted in the through hole. Then, a male screw member (not shown) is screwed into the screw hole of the axial support member through a coming-off preventive washer (not shown) or the like from the distal end face of the axial support member.

The shield attaching/removing manipulation lever 19 which is expressed by halftone in FIG. 13 has a first engaging pawl 82 at a portion above the male screw member 81, and a second engaging pawl 83 at a portion below the male screw member 81. Preferably, the first and second engaging pawls 82 and 83 have recessed inner surfaces so they become thin, and their outer surfaces are inclined to their inner surfaces from their proximal ends toward their distal ends so their thicknesses gradually decrease. Hence, each of the first and second engaging pawls 82 and 83 projects in the planar direction of the manipulation lever 19 to form an eaves structure. The manipulation lever 19 has a third engaging pawl 89 near a portion below the second engaging pawl 83. As shown in FIG. 13, the substantially arcuate guide 61 of the movable base member 22 engages the third engaging pawl 89 to prevent the manipulation lever 19 from suspending upward from the movable base member 22. Also, as shown in FIGS. 9 and 13, the shield attaching/removing manipulation lever 19 has a substantially arcuate guided portion 84, at its upper end, which is thin as its outer surface is recessed.

As shown in FIG. 9, a ring-like finger rest 85, where the helmet wearer is to place his fingers when pivoting the manipulation lever 19 forward, is integrally formed at the lower end of the shield attaching/removing manipulation lever 19. A spring accommodating recess 86, which is open not to the inner surface but also to the front side, is formed in the inner surface of the shield attaching/removing manipulation lever 19, between the male screw member 81 and finger rest 85, so as to oppose the spring accommodating recess 48 of the movable base member 22. A spring engaging projection 87 is formed on the rear side wall portion of the recess 86. The spring accommodating recess 48 of the movable base member 22 and the spring accommodating recess 86 of the shield attaching/removing manipulation lever 19 accommodate a common compression coil spring 88 such that its two ends engage with the spring engaging projections 49 and 87, as shown in FIG. 13.

(4) Shield Lock Manipulation Lever Serving Also as Shield Slightly-Opening Manipulation Lever As shown in FIG. 9, the shield lock manipulation lever 12 serving also as the shield slightly-opening manipulation lever, which functions as a shield lock manipulation member serving also as a shield slightly-opening manipulation member, has a pivotal ring 91 with a central opening 93. A click projection 90 is formed on the inner surface of the pivotal ring 91. A substantially rod-shaped finger rest 92 is integrally formed near the lower end of the pivotal ring 91. On the outer surface of the pivotal ring 91, a pair of upper and lower substantially arcuate guided portions 94*a* and 94*b* are formed at the inner surface end of the central opening 93.

As shown in FIGS. 9 and 13, near the upper end of the pivotal ring 91, a projection 95 is formed obliquely behind the pivotal ring 91 in a direction inclined with respect to the pivotal ring 91, to project obliquely upward. A shield lock engaging portion 96 is formed between the pivotal ring 91 and projection 95 to serve as an engaging notch. That side of the projection 95 which is opposite to the shield lock engaging portion 96 has an elongated ride-over aiding inclined surface 97 which inclines to be thinner from the engaging portion 96 side toward the opposite side. A cam projection 98 with an outer surface that serves as a cam surface 100 is formed, on the outer surface of the pivotal ring 91, at a portion close to the finger rest 92. A click notch 99 is formed adjacent to the finger rest 92-side end of the cam projection 98.

(5) Shield

As shown in FIG. 9, a substantially arcuate first guided portion 101, substantially arcuate second guided portion 102 and substantially arcuate third guided portion 103 are sequentially formed, near the left end of the inner surface of the shield 4, to locate from the left distal end to the central portion side of the shield 4. Preferably, the center of the virtual circle of the substantially arcuate first guided portion 101, the center of the virtual circle of the substantially arcuate second guided portion 102 and the center of the virtual circle of the substantially arcuate third guided portion 103 coincide substantially with a common central point $C_2$ shown in FIG. 9. As the outer surface of the first guided portion 101, at that end which is opposite to the central point $C_2$ (that is, a surface on the outer surface side of the shield 4), is recessed, the first guided portion 101 projects in a direction opposite to the central point $C_2$ to form an eaves structure.

As the outer surface of the second guided portion 102 at its end opposite to the central point $C_2$ is recessed, as shown in FIG. 9, the second guided portion 102 projects in a direction opposite to the central point $C_2$ to form an eaves structure. Furthermore, on the inner surface of the shield 4, a substantially arcuate curved cam surface portion 104 is integrally formed with the second guided portion 102. The center of the virtual circle of that surface of the substantially arcuate curved cam surface portion 104 which is opposite to the central point $C_2$ also preferably coincides substantially with the common central point $C_2$ shown in FIG. 9. The upper end of the curved cam surface portion 104 forms a cam projection 107. A cam surface 104*a* is formed, on that surface of the curved cam surface portion 104 which is on the central point $C_2$-side (including the outer surface of the cam projection 107) so as to be almost adjacent to the second guided portion 102 back to back. As the outer surface of the third guided portion 103 is recessed at its end on the central point $C_2$ side, the third guided portion 103 projects toward the central point $C_2$ to form an eaves structure. Furthermore, on the inner surface of the shield 4, a substantially arcuate click tooth portion 105 as a whole, which has one or a plurality of (six in the case of FIG. 9) teeth and substantially waves, is integrally formed with the third guided portion 103. The center of the virtual circle of the substantially arcuate click tooth portion 105 also preferably coincides substantially with the central point $C_2$ shown in FIG. 9. One or the plurality of teeth are formed in a substantially arcuate shape as a whole along an end of the click tooth portion 105 on a side opposite to the central point $C_2$. The third guided portion 103 is formed integrally with the click tooth portion 105 back to back. On the inner surface of the shield 4, the shield lock projection 15 integrally projects at a position slightly spaced apart from the third guided portion 103 in a direction opposite to the central point $C_2$.

(6) Assembly of Shield Attaching Mechanism

When assembling the left shield attaching mechanism 6, it is preferable to perform operations described in the following items (a) to (d) sequentially:

(a) to attach the movable base member 22 to the stationary base member 21;

(b) to attach the shield attaching/removing manipulation lever 19 and the shield lock manipulation lever 12 serving also as the shield slightly-opening manipulation lever to the movable base member 22;

(c) to attach a combination structure comprising the four members 21, 22, 19 and 12 to the left side of the outer surface of the head protecting body 2; and (d) to attach a portion near the left end of the shield 4 to the left movable base member 22 of the head protecting body 2.

The assembling operation of the left shield attaching mechanism 6 will be described below in the order described in the above items (a) to (d). As the right shield attaching mechanism 6 can be assembled in the substantially same manner as that of the assembly of the left shield attaching mechanism 6, only the assembling operation of the left shield attaching mechanism 6 will be described below.

When attaching the movable base member 22 shown in FIG. 9 to the stationary base member 21 shown in FIG. 9, as described in the above item (a), the movable base member 22 is overlaid on the stationary base member 21 such that the inner surface of the former and the outer surface of the latter are in contact, as shown in FIG. 12. The upper pair of upper and lower projecting ridges 35*a* and 35*b* and lower pair of upper and lower guided projecting ridges 38*a* and 38*b* of the movable base member 22 are relatively fitted in the upper pair of upper and lower guide grooves 26*a* and 26*b* and lower pair of upper and lower guide grooves 27*a* and 27*b* of the stationary base member 21, respectively. At this time, the cam follower 28 of the stationary base member 21 is inserted in the through hole 74 of the movable base member 22. Subsequently, the pair of upper and lower compression coil springs 31*a* and 31*b* are respectively accommodated in the pair of upper and lower spring accommodating recesses 32*a* and 32*b* of the stationary base member 21. At this time, the two ends of the upper compression coil spring 31*a* engage with the spring engaging projections 33*a* and 37*a*, respectively. The two ends of the lower compression coil spring 31*b* engage with the spring engaging projections 33*b* and 37*b*, respectively.

In this state, as shown in FIG. 12, the pair of upper and lower compression coil springs 31*a* and 31*b* elastically bias the movable base member 22 substantially backward (that is, substantially to the right in FIG. 12) to dispose it at the backward position. Therefore, front wall portions 40*a* and 40*b* serving as the stopped portions of the pair of upper and lower through holes 36*a* and 36*b* of the movable base member 22 respectively abut against front wall portions 50*a* and 50*b* serving as the stoppers of the pair of upper and lower high-level portions 39*a* and 39*b* of the stationary base member 21.

When attaching the shield attaching/removing manipulation lever 19 shown in FIG. 9 to the movable base member 22 shown in FIG. 9, as described in the above item (b), the shield attaching/removing manipulation lever 19 is overlaid on the movable base member 22 such that the inner surface of the former and the outer surface of the later are in contact, as shown in FIG. 13. The common compression coil spring 88 is accommodated in the spring accommodating recess 48 of the movable base member 22 and the recess 86 of the manipulation lever 19. At this time, the two ends of the compression coil spring 88 engage with the spring engaging projections 49 and 87. Simultaneously, the guided portion 84 of the manipulation lever 19 is inserted in the inner surface side of the guide 55 of the movable base member 22. The third engaging pawl 89 of the manipulation lever 19 is inserted in the inner surface side of the guide 61 of the movable base member 22. Subsequently, the male screw member 81 is inserted in the screw insertion hole of the manipulation lever 19 and screwed into the screw hole 52 of the movable base member 22 to pivotally, axially support the manipulation lever 19 with the movable base member 22.

In this state, as shown in FIG. 13, the compression coil spring 88 elastically biases the shield attaching/removing manipulation lever 19 counterclockwise in FIG. 13 about the male screw member 81 as the fulcrum, to dispose the manipulation lever 19 at the backward pivotal position. The guided portion 84 of the manipulation lever 19 abuts against the front end of the guide 55 of the movable base member 22. The manipulation lever 19 can pivot forward against the elastic biasing force of the compression coil spring 88 until the guided portion 84 abuts against the rear end of the guide 55 of the movable base member 22. When the manipulation lever 19 is at the backward pivotal position described above, its first engaging pawl 82 substantially closes a gap 111 in the movable base member 22 which is between a portion near the front end of the guide 55 and the guide 47, as shown in FIG. 13. The second engaging pawl 83 of the manipulation lever 19 substantially closes a gap 112 in the movable base member 22 which continues to a portion substantially above the third guide 61.

When attaching the shield lock manipulation lever 12 serving also as the shield slightly-opening manipulation lever to the movable base member 22, as described in the above item (b), the manipulation lever 12 is overlaid on the movable base member 22 such that the inner surface of the former and the outer surface of the latter are in contact, as shown in FIG. 13. By strongly urging the pair of upper and lower guided portions 94*a* and 94*b* of the manipulation lever 12 against the pair of upper and lower guide projections 13*a* and 13*b* of the movable base member 22, the guided portions 94*a* and 94*b* engage with the guide projections 13*a* and 13*b*. In this state, the manipulation lever 12 can reciprocally pivot with respect to the axial support 62 of the movable base member 22 within a range where the guide projections 13*a* and 13*b* relatively slide along the guided portions 94*a* and 94*b*. Subsequently, the manipulation lever 12 is pivoted to a predetermined pivot position to fit the click projection 90 in the central click recess (that is, the recess to be normally used) 60*b* among the three click recesses 60*a* to 60*c* of the movable base member 22.

When attaching the assembly structure comprising the four members 21, 22, 19 and 12 shown in FIG. 9 to the left side of the outer surface of the head protecting body 2, as described in the above item (c), first, the pair of male screw members 24*a* and 24*b* shown in FIG. 9 are inserted in the pair of upper and lower screw insertion holes of the stationary base member 21. Subsequently, the pair of male screw members 24*a* and 24*b* are screwed and fixed in the pair of screw holes 30*a* and 30*b* shown in FIG. 10 for the pair of male screw members 24*a* and 24*b*.

Figure 6:
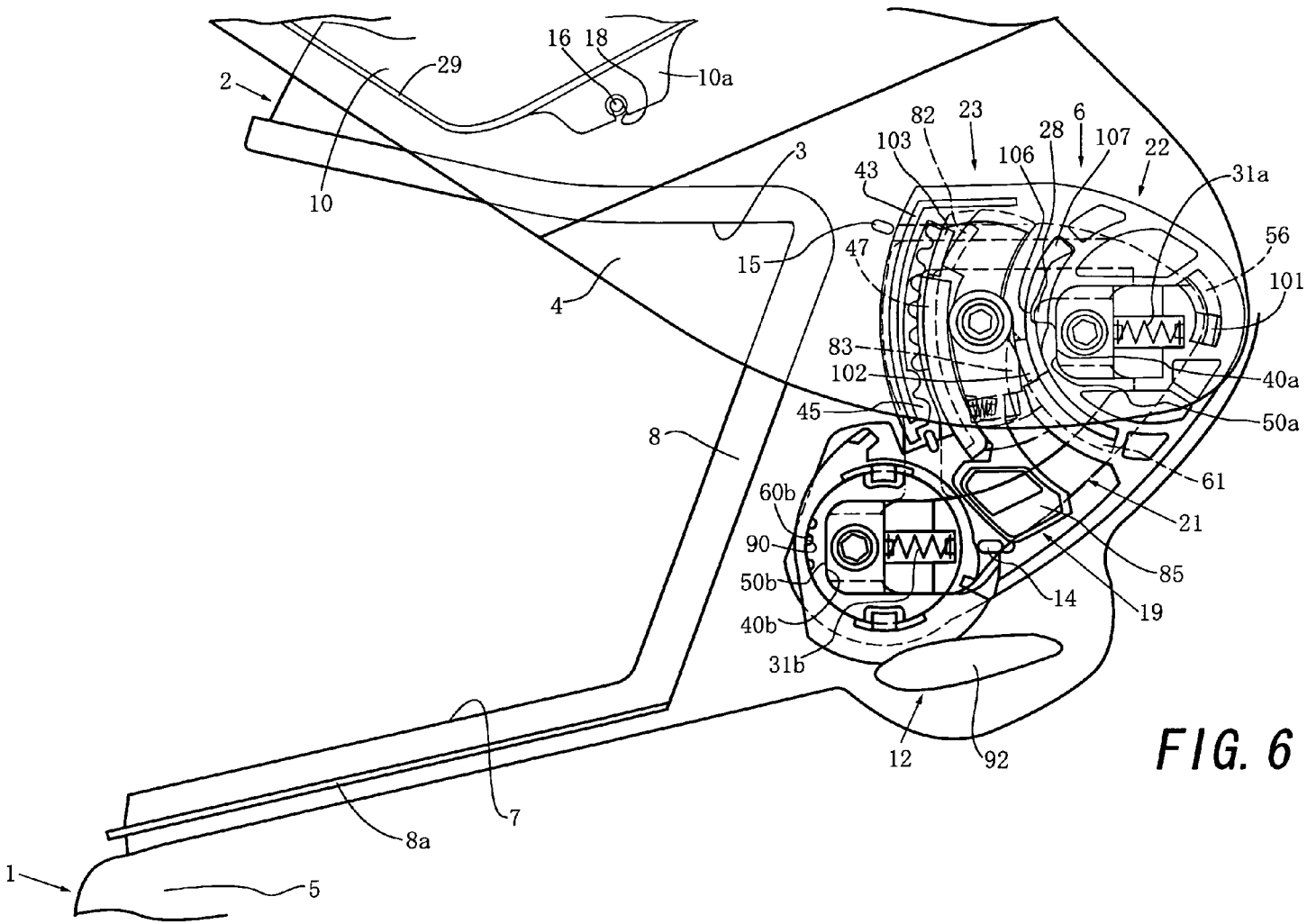
FIG. 6 is an enlarged left side view, similar to FIG. 5, of a state wherein a shield attaching/removing manipulation lever is pivoted forward.

When attaching the left end of the shield 4 to the movable base member 22, as described in the above item (d), the shield attaching/removing manipulation lever 19 shown in FIG. 13 may be pivoted forward clockwise in FIG. 13 about the male screw member (in other words, the axial support) 81 as the fulcrum against the elastic biasing force of the compression coil spring 88 (see FIG. 6). However, the manipulation lever 19 need not be operated in this manner. In place of this operation, the first guided portion 101, second guided portion 102 and third guided portion 103 of the shield 4 may be abutted against the second guide 56 of the movable base member 22 and the second engaging pawl 83 and first engaging pawl 82 of the shield attaching/removing manipulation lever 19, respectively, and thereafter a portion of the shield 4 near the left end may be strongly urged against the movable base member 22. In this case, as the second and third guided portions 102 and 103 of the shield 4 strongly urge the second and first engaging pawls 83 and 82 of the manipulation lever 19, the manipulation lever 19 pivots forward against the elastic biasing force of the compression coil spring 88, in the substantially same manner as in the case of the forward pivot operation described above. Consequently, the first guided portion 101 of the shield 4 engages with the second guide 56 of the movable base member 22. Simultaneously, the second and third guided portions 102 and 103 of the shield 4 are positioned in the gaps 112 and 111, respectively, of the movable base member 22. Hence, the elastic biasing force of the compression coil spring 88 pivots the manipulation lever 19 backward counterclockwise in FIG. 6 about the male screw member 81 as the fulcrum. Therefore, the second and first engaging pawls 83 and 82 of the manipulation lever 19 prevent the second and third guided portions 102 and 103 of the shield 4 from suspending (that is, separating from the movable base member 22).

Figure 5:
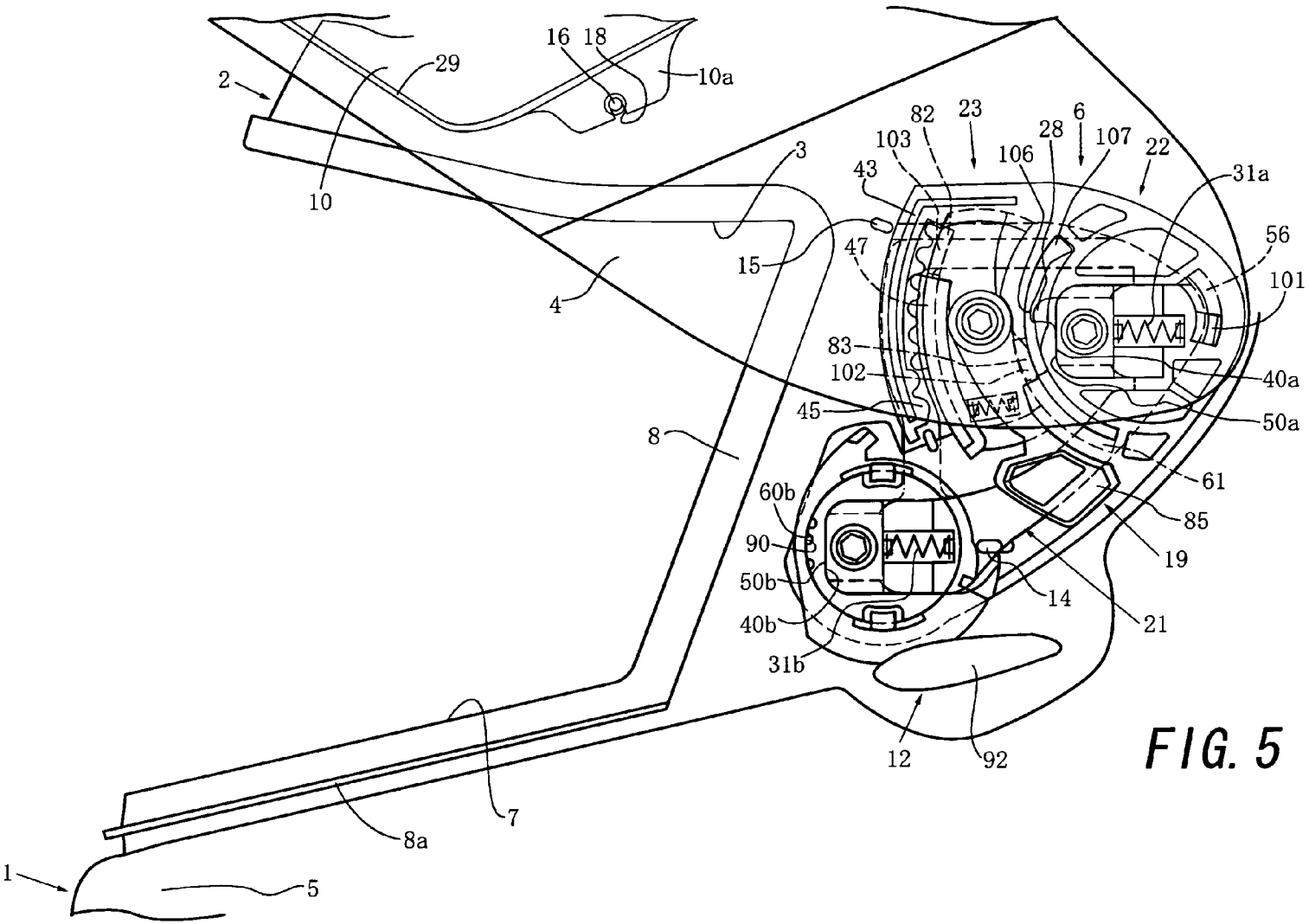
FIG. 5 is an enlarged left side view similar to FIG. 2, in which the shield is in a fully-open state.

In this state, the shield 4 is in the fully-open state shown in FIG. 5. Accordingly, the curved cam surface portion 104 of the shield 4 has moved upward so the cam follower 28 of the stationary base member 21 abuts against a substantially central portion (more specifically, the recess 106) in the longitudinal direction of the cam surface 104*a*. The click tooth portion 105 of the shield 4 has moved upward so the lowermost tooth among its plurality of teeth is adjacent to the uppermost tooth, among the plurality of click tooth portions 45 of the movable base member 22, on the upper side of the uppermost teeth. In this state, the common central point $C_1$ of the movable base member 22 and the common central point $C_2$ of the shield 4 substantially match.

The assembling operation described in the above items (a) to (d) can attach the shield attaching mechanism 6 to the head protecting body 2.

3. Operation of Shield Attaching Mechanism

The shield 4 can employ at least the states described in the following items (a) to (g):

(a) fully-closed state shown in FIGS. 1 and 2;
(b) stage-1 open state shown in FIG. 3;
(c) stage-4 open state shown in FIG. 4;
(d) fully-open state shown in FIG. 5;
(e) removable state shown in FIG. 6;
(f) slightly-open state shown in FIG. 7; and
(g) locked state shown in FIG. 8.

The operation of the shield attaching mechanism will be described below in "(1) fully-closed state", "(2) stage-1 open state", "(3) stage-4 open state", "(4) fully-open state", "(5) removable state", "(6) slightly-open state" and "(7) locked state" with reference to FIGS. 1 to 14.

(1) Fully-Closed State

The shield 4 is in the fully-open state shown in FIG. 5 immediately after it attaches to the movable base member 22 as described in the above item 2(6). When pivoting the shield 4 downward from above about the common central points $C_2$ at its right and left ends as the pivot center by, e.g., placing the fingers on the finger rest 11 of the shield 4, the shield 4 is set in the fully-closed state shown in FIG. 2. In the fully-closed state, the lower end of the shield 4 comes into contact with the projecting ridge 8*a* of the window opening rim member 8. Also, each of the first to third guided portions 101 to 103 of the shield 4 abuts against one terminal end of the corresponding one of the second, third and first guides 56, 61 and 47 of the movable base member 22, or is set in a state immediately before abutting against it. The operation of the shield attaching mechanism 6 from the fully-open state to the fully-closed state is substantially opposite to the operation from the fully-closed state to the fully-open state, and a detailed description will not be repeated here.

In the fully-closed state shown in FIG. 2, the cam follower 28 of the stationary base member 21 relatively abuts against the cam surface 104*a* of the curved cam surface portion 104 of the shield 4, or is located above the cam surface 104*a* to be relatively close to it. Hence, the movable base member 22 is at a backward position with respect to the stationary base member 21, substantially in the same manner as in the case shown in FIG. 12. The uppermost teeth of the click tooth portion 105 of the shield 4 abuts against the lowermost teeth of the click tooth portion 45 of the movable base member 22 from below, or is located below the lowermost teeth to be close to it.

In the fully-closed state shown in FIG. 2, the shield lock manipulation lever 12 serving also as the shield slightly-opening manipulation lever is at the neutral position. Thus, the shield lock projection 15 of the shield 4 does not engage with the shield lock engaging portion 96 of the manipulation lever 12. Also, the shield slightly-opening projection 14 of the stationary base member 21 neither at all or hardly rides over the cam surface 100 of the cam projection 98 of the manipulation lever 12 relatively, nor engages with the click notch 99 of the manipulation lever 12. The elastic biasing force of the compression coil spring 88 holds the shield attaching/removing manipulation lever 19 at the backward position, substantially in the same manner as in the case shown in FIG. 13.

(2) Stage-1 Open State

Figure 3:
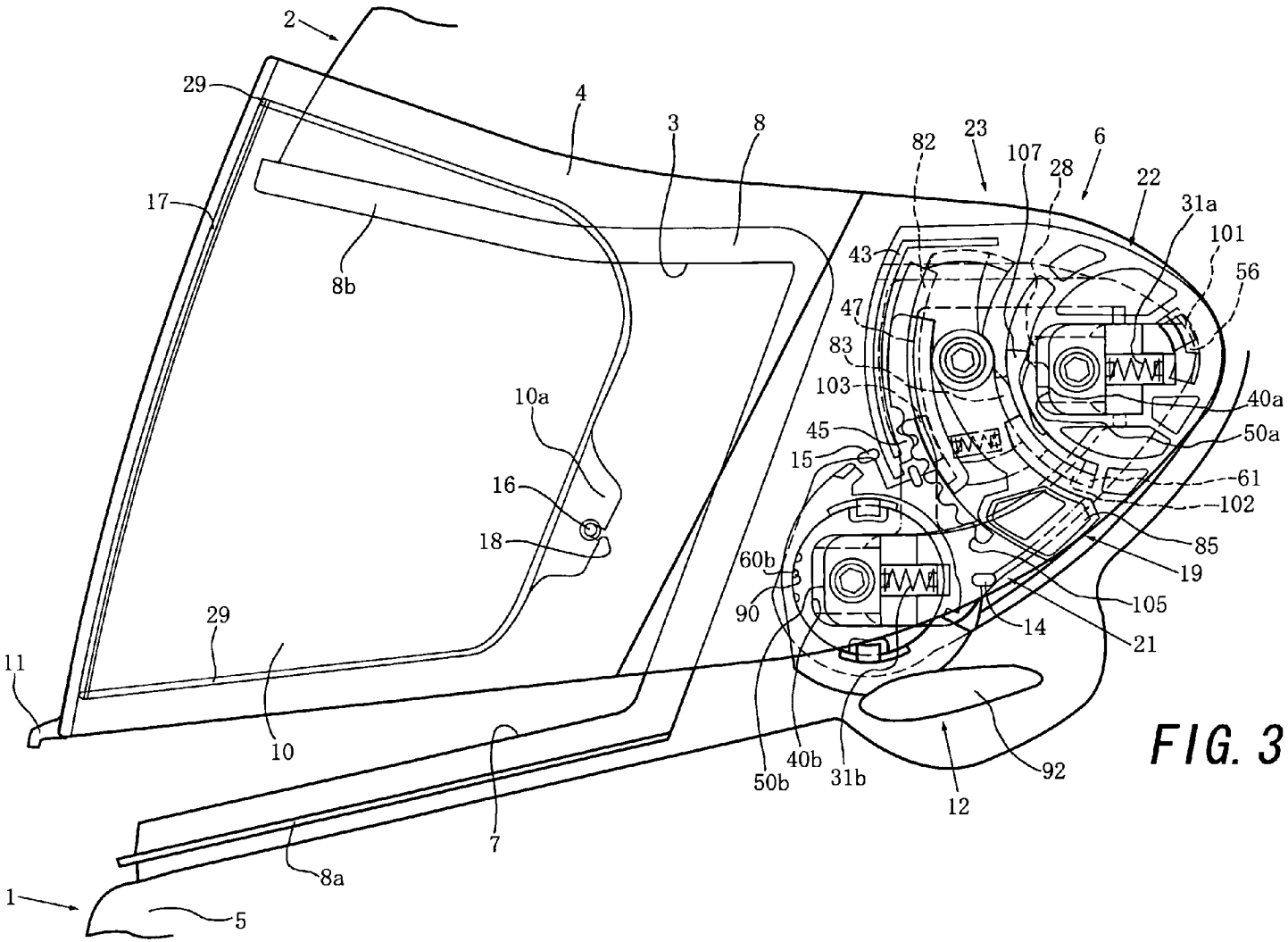
FIG. 3 is an enlarged left side view similar to FIG. 2, in which the shield is in a stage-1 open state.

In the fully-closed state shown in FIG. 2, when the shield 4 is slightly raised by, e.g., placing fingers on the finger rest 11, it is set in the stage-1 open state shown in FIG. 3. When attaining the stage-1 open state, the shield 4 slightly pivots forward clockwise in FIG. 2 with respect to the movable base member 22 about the common central point $C_2$ as the pivot center. Thus, the second, third and first guides 56, 61 and 47 of the movable base member 22 respectively guide the first to third guided portions 101 to 103 of the shield 4 to pivot them forward clockwise in FIG. 2 about the common central point $C_2$ as the pivot center. The uppermost tooth of the click tooth portion 105 of the shield 4 meshes with the click tooth portion 45 of the movable base member 22, as shown in FIG. 3, to hold the shield 4 accurately in the stage-1 open state.

When the shield 4 in the fully-closed state shown in FIG. 2 changes to be set in the stage-1 open state shown in FIG. 3, the cam projection 107 of the curved cam surface portion 104 of the shield 4 pivots clockwise, as it is pushed out forward (that is, to the left in FIG. 2) by the cam follower 28 of the stationary base member 21, to ride over the cam follower 28. This ride-over takes place when the movable base member 22 linearly moves forward to the front side, together with the shield 4, with respect to the stationary base member 21 against the elastic biasing forces of the compression coil springs 31*a* and 31*b*. Therefore, when the shield 4 moves upward to the stage-1 open state, the shield 4 (and accordingly the anti-fogging auxiliary shield 10 attaching to its inner surface) is pushed out to the front side by, e.g., 3 mm. Hence, when the shield 4 changes to be set in the stage-1 open state, the shield 4 and anti-fogging auxiliary shield 10 do not catch on the window opening rim member 8 (particularly its upper rim portion 8*b*) to be unable to move upward smoothly.

Figure 14:
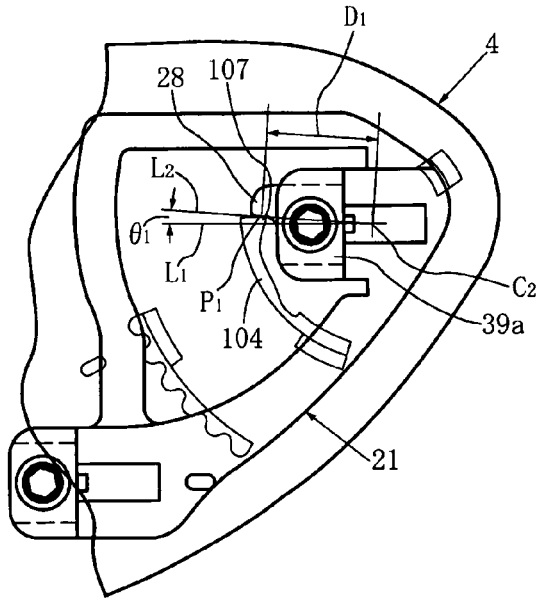
FIG. 14 is an enlarged side view of the main part of the helmet showing the mutual positional relationship between the stationary base member and shield in the fully-closed state shown in FIG. 2.

FIG. 14 shows the mutual positional relationship between the stationary base member 21 and shield 4 in the fully-closed state shown in FIG. 2 or a semi-fully-closed state. The semi-fully-closed state refers to a state wherein, when the curved cam surface portion 104 of the shield 4 does not yet abut against the cam follower 28 of the stationary base member 21 in the fully-closed state shown in FIG. 2, the shield 4 is slightly raised from the fully-closed state, so the curved cam surface portion 104 starts to abut against the cam follower 28. In FIG. 14, reference symbol $P_1$ denotes the mutual contact portion of the curved cam surface portion 104 and cam follower 28 in the fully-closed state shown in FIG. 2 or the semi-fully-closed state. Reference symbol $C_2$ denotes the common central point of the shield 4. Reference symbol $\theta_1$ denotes an angle formed by a straight line $L_1$ which extends through the common central point $C_2$ along the reciprocal direction of the movable base member 22 with respect to the stationary base member 21, and a straight line $L_2$ which connects the common central point $C_2$ and the contact portion $P_1$. Reference symbol $D_1$ denotes a distance between the common central point $C_2$ and contact portion $P_1$.

In FIG. 14, the angle $\theta_1$ is about −5°, and the distance $L_1$ is about 16.5 mm. In this case, this negative value represents a value of a case wherein the contact portion $P_1$ is above the straight line $L_1$. Generally, from the viewpoint of practicability, the angle $\theta_1$ and distance $D_1$ preferably satisfy at least one of the numerical ranges described in the following items (a) and (b). The numerical ranges in the parentheses of items (a) and (b) indicate numerical ranges that should be satisfied more preferably.

(a) angle $\theta_1$: numerical range of −20° to 50° (−10° to 40°) and (b) distance $D_1$: numerical range of 8 mm to 80 mm (12 mm to 60 mm)

(3) Stage-4 Open State

Figure 4:
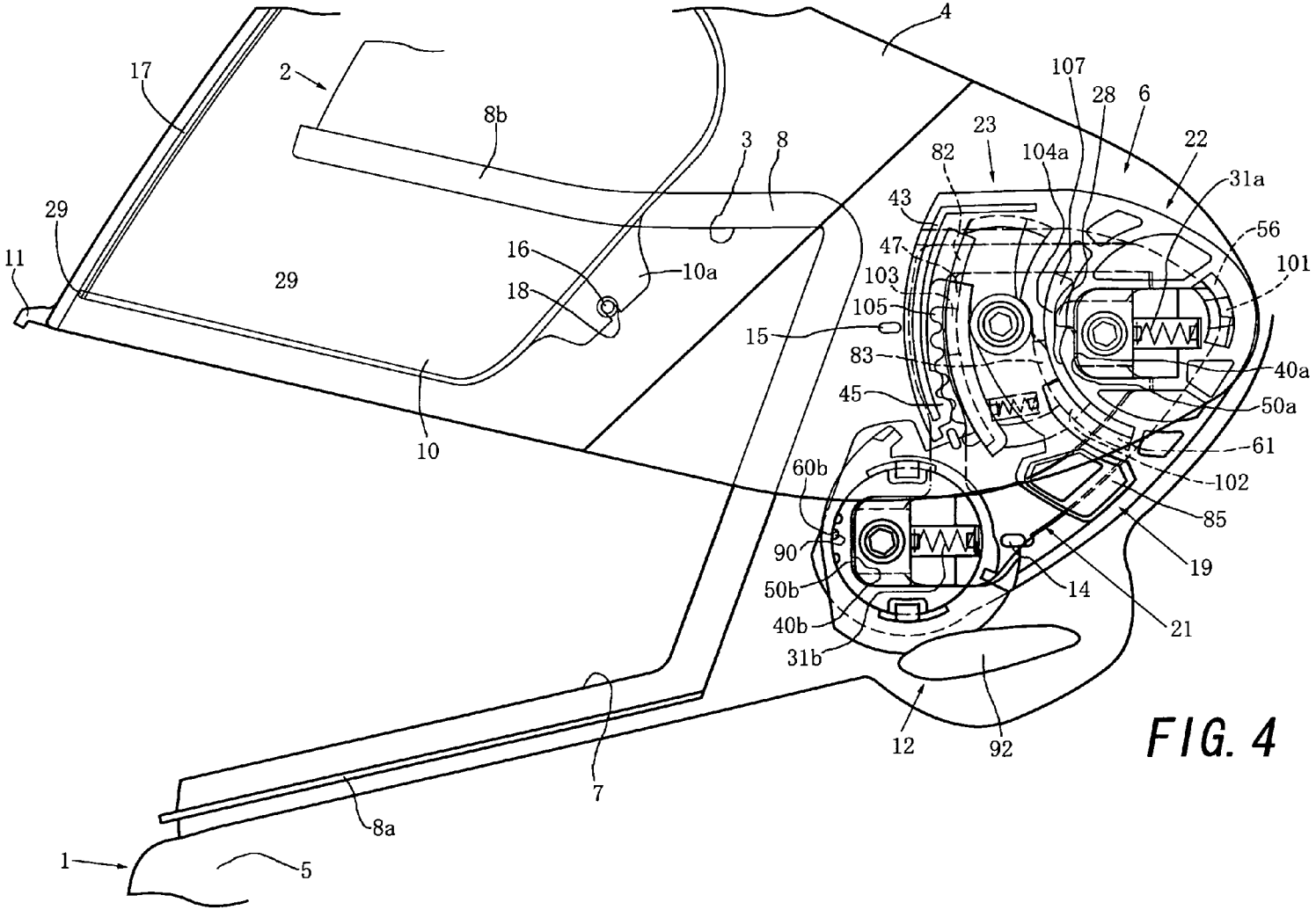
FIG. 4 is an enlarged left side view similar to FIG. 2, in which the shield is in a stage-4 open state.

In the stage-1 open state shown in FIG. 3, when further pulling up the shield 4 largely, it is set in the stage-4 open state shown in FIG. 4. When setting the shield 4 in the stage-4 open state, it further pivots largely clockwise in FIG. 3 with respect to the movable base member 22 about the common central point $C_2$ as the pivot center. Hence, the first to third guided portions 101 to 103 of the shield 4 are also respectively guided by the second, third and first guides 56, 61 and 47 of the movable base member 22 to pivot clockwise in FIG. 3 about the common central point $C_2$ as the pivot centers. The 4th tooth from the top of the click tooth portion 105 of the shield 4 meshes with the click tooth portion 45 of the movable base member 22, as shown in FIG. 4, to hold the shield 4 accurately in the stage-4 open state.

When the shield 4 in the stage-1 open state shown in FIG. 3 shifts to the stage-4 open state shown in FIG. 4, the cam surface 104*a* of its curved cam surface portion 104 abuts against the cam follower 28 of the stationary base member 21 at a portion slightly below the cam projection 107 of the curved cam surface portion 104. Thus, the curved cam surface portion 104 pivots forward clockwise in FIG. 3 about the common central point $C_2$ as the pivot center while gradually moving to the rear side (that is, to the right in FIG. 2). This movement to the rear side takes place when the elastic biasing forces of the compression coil springs 31*a* and 31*b* linearly move the movable base member 22, together with the shield 4, backward to the rear side with respect to the stationary base member 21. Therefore, when the shield 4 moves upward from the stage-1 open state to the stage-4 open state, it (and accordingly the anti-fogging auxiliary shield 10 attaching to its inner surface) is slightly retracted from the front side to the rear side. When pulling up the shield 4 from the stage-1 open state to the stage-4 open state, the shield 4 and anti-fogging auxiliary shield 10 can be prevented from projecting from the head protecting body 2 to the front side more than necessary. This can prevent the shield 4 from being fluttered by the traveling wind more or less. This also applies to the fully-open state described in the following item (4).

(4) Fully-Open State

In the stage-4 open state shown in FIG. 4, when further pulling up the shield 4 slightly, it is set in the fully-open state'(that is, maximal open state) shown in FIG. 5. When shifting to the fully-open state, the shield 4 further pivots forward slightly clockwise in FIG. 4 with respect to the movable base member 22 about the common central point $C_2$ as the pivot center. The fully-open state shown in FIG. 5 is substantially the same as the state immediately after attaching the shield 4 to the head protecting body 2, which has been explained in the above item 2(6) concerning the operation described in item (d), and a repetitive description will be omitted. In the fully-open state shown in FIG. 5, the cam follower 28 of the stationary base member 21 is located in a recess 106 of the cam surface 104*a* of the shield 4. Accordingly, the common central point $C_2$ as the pivot center of the shield 4 and anti-fogging auxiliary shield 10 is held at a position which is retracted to the most rear side between the stage-1 open state to the fully-open state. In this state, the stopped portions 40*a* and 40*b* of the pair of upper and lower through holes 36*a* and 36*b* of the movable base member 22 respectively abut against the stoppers 50*a* and 50*b* of the pair of upper and lower high-level portions 39*a* and 39*b* of the stationary base member 21.

(5) Removable State

In the fully-open state shown in FIG. 5, when the shield attaching/removing manipulation lever 19 is pivoted forward clockwise in FIG. 5 about the male screw member 81 as the fulcrum against the elastic biasing force of the compression coil spring 88, the shield 4 is set in the removable state shown in FIG. 6. The removable state is substantially the same as the state of the forward pivot operation of the shield attaching/removing manipulation lever 19 explained in the above item 2(6) concerning the operation described in item (d), and a repetitive description will be omitted. In the removable state shown in FIG. 6, by performing operation opposite to that explained in the above item 2(6) concerning the operation described in item (d), the left end of the shield 4 can be easily removed from the movable base member 22.

In the removable state, as described in the above item (4), the stopped portions 40*a* and 40*b* of the pair of upper and lower through holes 36*a* and 36*b* of the movable base member 22 respectively abut against the stoppers 50*a* and 50*b* of the pair of upper and lower high-level portions 39*a* and 39*b* of the stationary base member 21. Thus, the movable base member 22 completely moves backward with respect to the stationary base member 21. Hence, before and after removing the shield 4 from the movable base member 22, the elastic biasing forces of the compression coil springs 31*a* and 31*b* will not further move the movable base member 22 backward with respect to the stationary base member 21. This also applies before and after attaching the shield 4 to the movable base member 22. Therefore, the shield 4 can be attached to and removed from the movable base member 22 easily and reliably.

(6) Slightly-Open State

Figure 7:
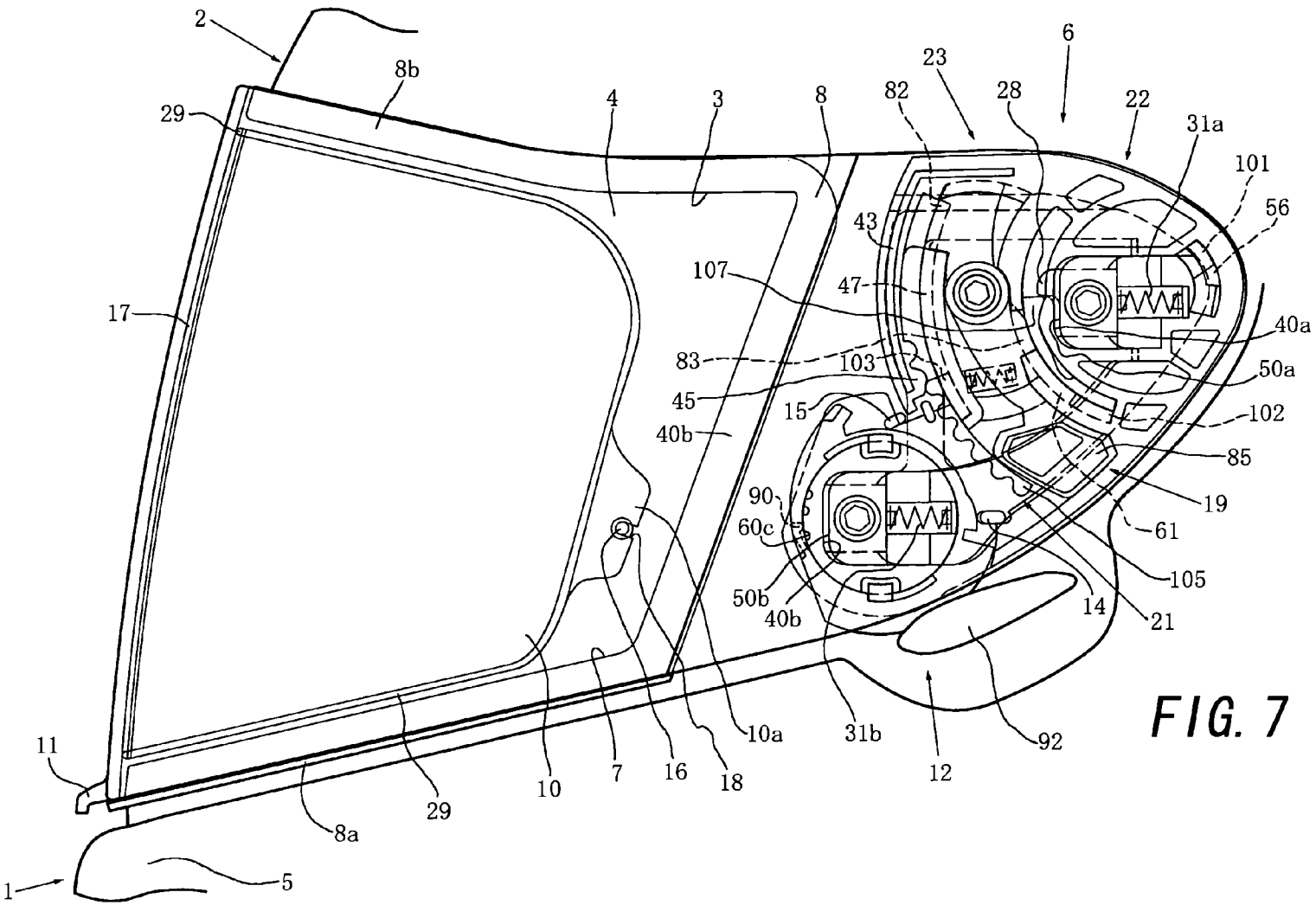
FIG. 7 is an enlarged left side view, similar to FIG. 2, of a state wherein a shield lock manipulation lever serving also as a shield slightly-opening manipulation lever is pivoted forward in a slightly-opening direction.

In the fully-closed state shown in FIG. 2, when pivoting the shield lock manipulation lever 12 serving also as the shield slightly-opening manipulation lever forward in the first forward pivot direction (that is, counterclockwise in FIG. 2) by, e.g., placing the fingers on the finger rest 92, the slightly-open state shown in FIG. 7 is obtained. When the manipulation lever 12 is in the backward pivot state shown in FIG. 2, the click projection 90 of the manipulation lever 12 engages with the click recess 60*b* of the movable base member 22. The forward pivot motion of the manipulation lever 12 solves this engagement. In the slightly-open state, the shield slightly-opening projection 14 of the stationary base member 21 relatively rides over the cam projection 98 of the manipulation lever 12. Accordingly, the manipulation lever 12 is to move forward, together with the movable base member 22, to the front side, and the movable base member 22, together with the manipulation lever 12, linearly moves forward to the front side with respect to the stationary base member 21 against the elastic biasing forces of the compression coil springs 31*a* and 31*b*. This linear forward movement takes place when the guide grooves 26*a*, 26*b*, 27*a* and 27*b* of the stationary base member 21 respectively guide the guided projecting ridges 35*a*, 35*b*, 38*a* and 38*b* of the movable base member 22. When further pivoting the manipulation lever 12 forward in the first forward pivot direction, one end of the shield slightly-opening projection 14 of the stationary base member 21 relatively enters the click notch 99 of the manipulation lever 12. Simultaneously, the click projection 90 of the manipulation lever 12 also engages with the click recess (that is, a recess for slight opening) 60*c* of the movable base member 22. This click motion reliably holds the manipulation lever 12 in this state.

In the slightly-open state shown in FIG. 7, the shield 4 accompanying the movable base member 22 also moves forward to the front side. The shield 4 is thus spaced apart from the head protecting body 2 (particularly its window opening rim member 8). This allows intake of air into the head protecting body 2 through its window opening 3. In the case of the fully-open state shown in FIG. 6 or the like (that is, cases other than the fully-closed state) as well, the manipulation lever 12 can be pivoted forward in the first forward pivot direction. This forward pivot motion linearly moves the shield 4 forward to the front side substantially in the same manner. When lowering the shield 4 to the lowermost end to set it in the fully-closed state, the same slightly-open state as that obtained when pivoting the manipulation lever 12 forward from the fully-closed state can be obtained. When restoring the shield 4 from the slightly-open state to the fully-closed state, the manipulation lever 12 may be pivoted backward in a direction opposite to the first forward pivot direction (that is, the first backward pivot direction). This backward pivot motion separates the click projection 90 of the manipulation lever 12 from the click recess 60*c* of the movable base member 22 and engages it with the click recess 60*b* again.

(7) Locked State

Figure 8:
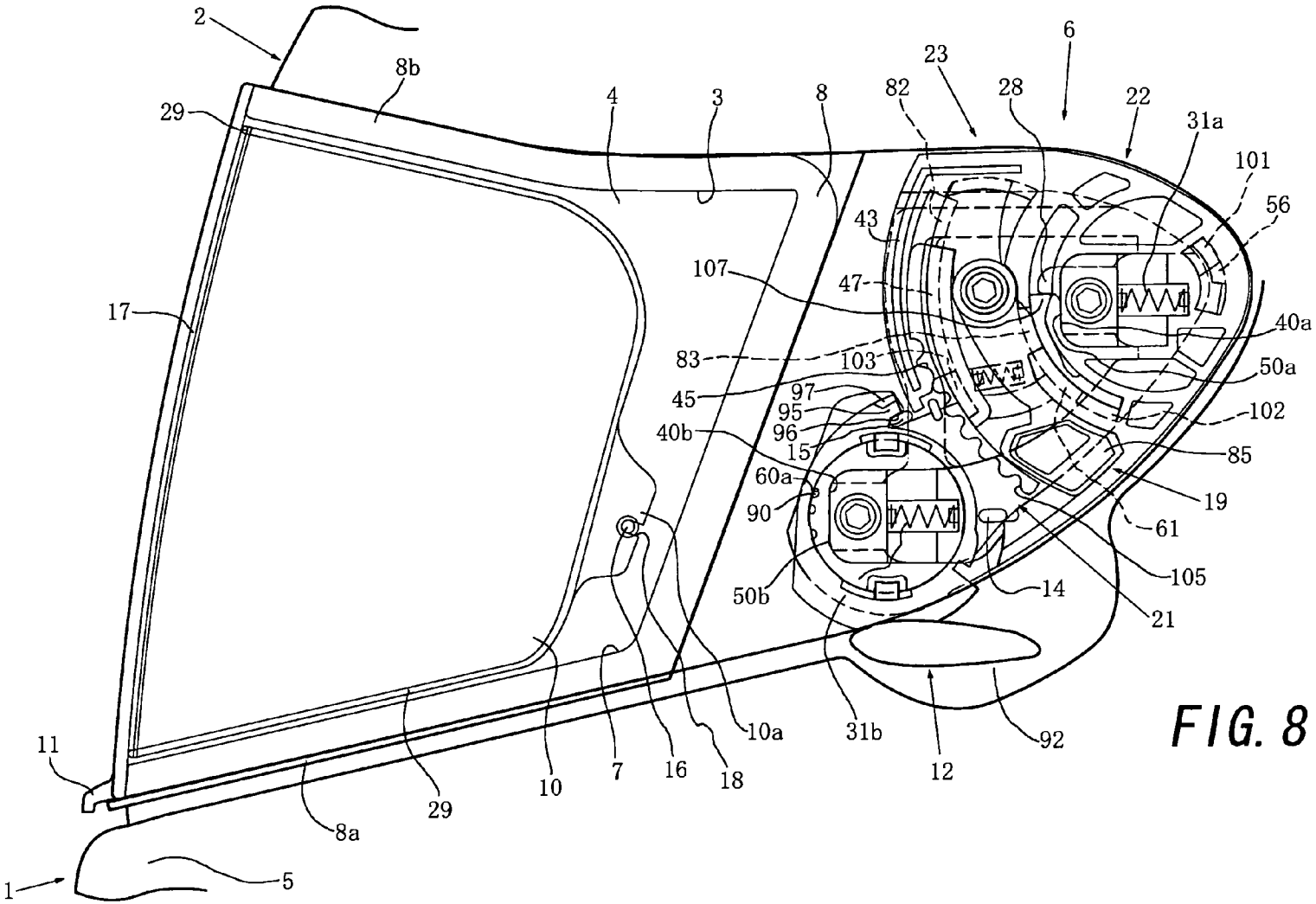
FIG. 8 is an enlarged left side view, similar to FIG. 2, of a state wherein the shield lock manipulation lever serving also as the shield slightly-opening manipulation lever is pivoted forward in a locking direction opposite to that of the case in FIG. 7.

In the fully-closed state shown in FIG. 2, when pivoting the shield lock manipulation lever 12 serving also as the shield slightly-opening manipulation lever forward in the second forward pivot direction (that is, clockwise in FIG. 2), the shield-locked state shown in FIG. 8 is obtained. The forward pivot motion of the manipulation lever 12 separates the click projection 90 of the manipulation lever 12 from the click recess 60*b* of the movable base member 22 and engages it with the click recess (that is, a locking recess) 60*a*. Also, in the shield-locked state, the shield lock projection 15 serving as the shield lock engaged portion for the shield 4 relatively engages with the shield lock engaging portion 96 of the manipulation lever 12. This inhibits the shield 4 from moving upward and firmly holds (that is, locks) it in the fully-closed state until this engagement is canceled.

In the case of the fully-open state shown in FIG. 5 or the like (that is, cases other than the fully-closed state) as well, the manipulation lever 12 can be pivoted forward in the second forward pivot direction. In this state, when setting the shield 4 in the fully-closed state, its shield lock projection 15 abuts against the ride-over aiding inclined surface 97 of the manipulation lever 12 to relatively ride over the projection 95. Accordingly, the shield lock projection 15 engages with the shield lock engaging portion 96, providing the locked state as described above. When restoring the shield 4 from the shield-locked state to the shield-unlocked state (that is, the normal fully-closed state shown in FIG. 2), the manipulation lever 12 may be pivoted backward in a direction opposite to the second forward pivot direction (that is, the second backward pivot direction). This backward pivot motion separates the click projection 90 of the manipulation lever 12 from the clock recess 60*a* of the movable base member 22 and engages it with the click recess 60*b* again.

B. Second Embodiment

The second embodiment of the present invention will be described in "1. Schematic Arrangement of Helmet as a Whole", "2. Arrangement of Shield Attaching Mechanism" and "3. Operation of Shield Attaching Mechanism" with reference to FIGS. 15 to 23. The second embodiment shown in FIGS. 15 to 23 can have substantially the same arrangement as that of the first embodiment described above except for the respects to be described below. Hence, in FIGS. 15 to 23, portions that are common with FIGS. 1 to 14 are denoted by the same reference numerals, and a repetitive description will be omitted where appropriate.

1. Schematic Arrangement of Helmet as a Whole

Figure 15:
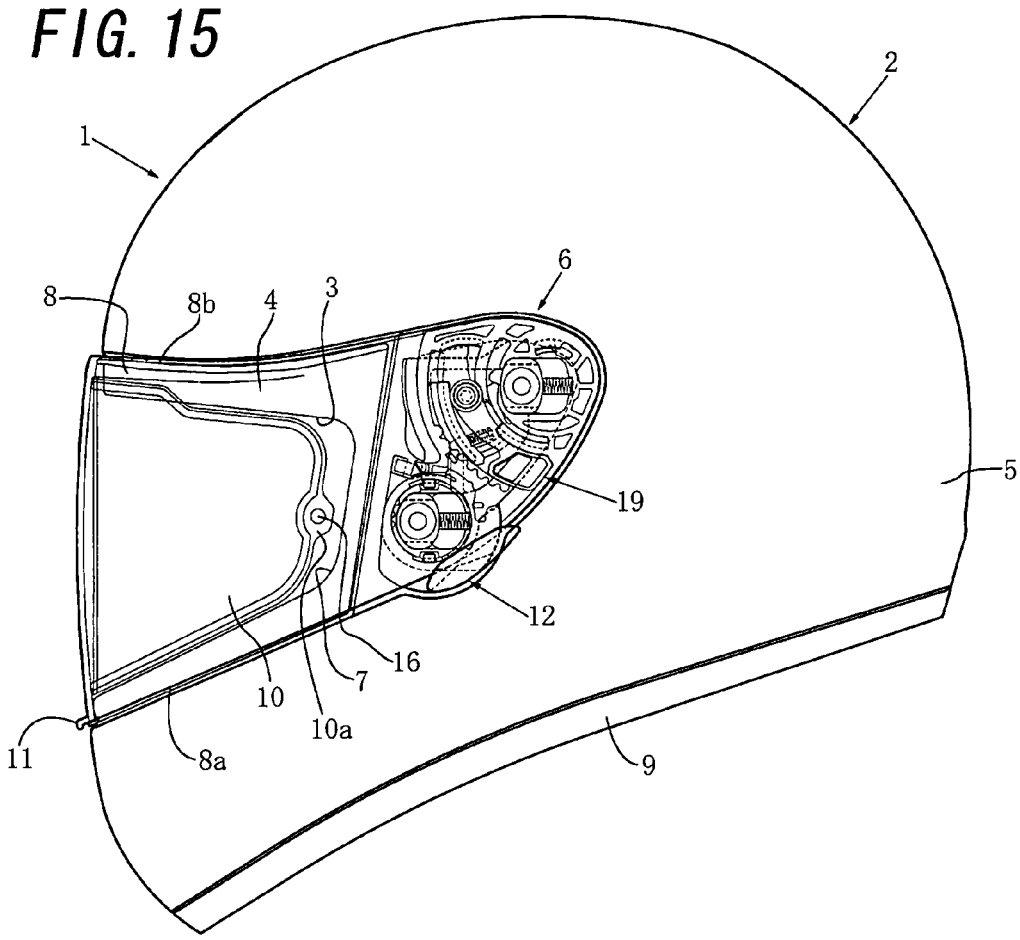
FIG. 15 is a schematic left side view of a helmet as a while, in which a shield is in a fully-closed state, according to the second embodiment in which the present invention is applied to a full-face-type helmet shield attaching mechanism.
Figure 16:
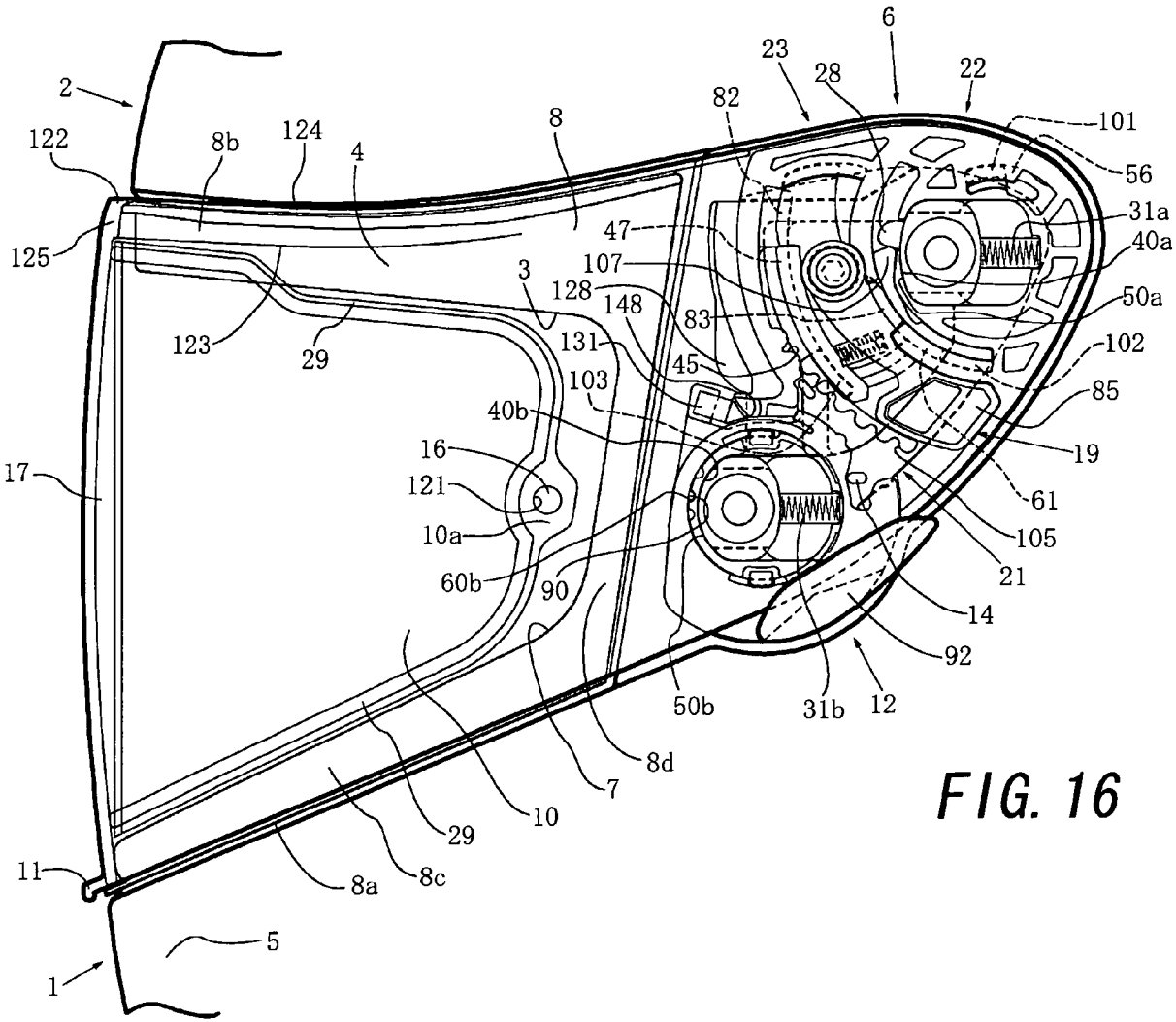
FIG. 16 is an enlarged left side view of the main part of the helmet to show the shield attaching mechanism in FIG. 15.

In the second embodiment, as shown in FIGS. 15 and 16, in place of the pair of right and left engaging slits 18 in the above first embodiment, a pair of right and left through holes 121 are formed near a pair of right and left tongue pieces 10*a* of an anti-fogging auxiliary shield 10. By fitting a pair of right and left engaging pins 16 in the pair of right and left through holes 121, the anti-fogging auxiliary shield 10 is attached to the inner surface of the shield 4.

As shown in FIG. 16, the shield 4 has an engaging projecting ridge 122, on its inner surface, along its upper end. The engaging projecting ridge 122 extends from the center in the left-and-right direction of the shield 4 to the right and left directions, beyond portions respectively corresponding to the right and left ends of a window opening 7, to near a pair of right and left shield attaching mechanisms 6. The shield 4 has a downward step 123, on its inner surface, at a portion slightly below the engaging projecting ridge 122 to extend substantially in the horizontal direction. The downward step 123 extends from the center in the left-and-right direction of the shield 4 to the right and left directions to slightly before portions respectively corresponding to the right and left ends of the window opening 7. This forms a thick portion 125 on the shield 4 between the engaging projecting ridge 122 and downward step 123. Near the right and left ends of the downward step 123, the thick portion 125 gradually decreases its thickness to form an inclined surface.

As shown in FIG. 16, a window opening rim member 8 is wider as a whole in the planar direction of an outer shell 5 than in the case of the first embodiment described above. An upper rim portion 8*b* of the window opening rim member 8 comprises a portion with a substantially U-shaped section which is to fit with the rim portion of the outer shell 5, and an engaging projecting ridge 124 which projects from the outer surface at the upper end of the substantially U-shaped portion outwardly in the substantially horizontal direction. A lower rim portion 8*c* of the window opening rim member 8 comprises a portion with a substantially inverted-U-shaped section which is to fit with the rim portion of the outer shell 5, and a projecting ridge 8*a*, identical to that described above, which projects from the outer surface at the lower end of the substantially inverted-U-shaped portion outwardly in the substantially horizontal direction. Each of right and left rim portions 8*d* of the window opening rim member 8 may have a substantially U- or E-shaped section, as is conventionally known, or the same sectional shape as that of the upper rim portion 8*b*.

In the second embodiment, even when the shield 4 is in the fully-closed state shown in FIG. 16, the central portion of the upper portion of a packing projecting ridge 29 of the anti-fogging auxiliary shield 10 overlaps on the upper rim portion 8*b* of the window opening rim member 8 when seen from the front. Hence, the anti-fogging auxiliary shield 10 does not easily enter the field of view of the helmet wearer. Yet, as shown in FIG. 16, the engaging projecting ridge 124 is provided to the upper rim portion 8*b* of the window opening rim member 8, and the downward step 123 and engaging projecting ridge 122 are provided to the shield 4. This can reduce the inward projecting amount of the auxiliary shield 10 from the inner surface of the thick portion 125. The upper rim portion 8*b* and shield 4 are well in tight contact with each other. Thus, traveling wind does not easily enter the shield 4 to decrease the hissing sound of the wind, and leak of rainwater or the like is prevented. Also, the inner surface of the anti-fogging auxiliary shield 10 can be prevented from rubbing on the upper rim portion 8*b* of the window opening rim member 8 to become rough each time the shield 4 is raised or lowered. As in the known case wherein, e.g., the upper rim portion 8*b* of the window opening rim member 8 has a substantially E-shaped section, each time the shield 4 is raised or lowered, the shield 4 or anti-fogging auxiliary shield 10 can be prevented from rubbing on the upper rim portion 8*b* to eventually turn over the free piece of the upper rim portion 8*b*.

2. Arrangement of Shield Attaching Mechanism

The arrangement of the left shield attaching mechanism 6 will be described in "(1) stationary base member", "(2) movable base member", "(3) shield attaching/removing manipulation lever", "(4) shield lock manipulation lever serving also as shield slightly-opening manipulation lever", "(5) shield" and "(6) assembly of shield attaching mechanism" with reference to FIGS. 15 to 23.

(1) Stationary Base Member

Figure 20:
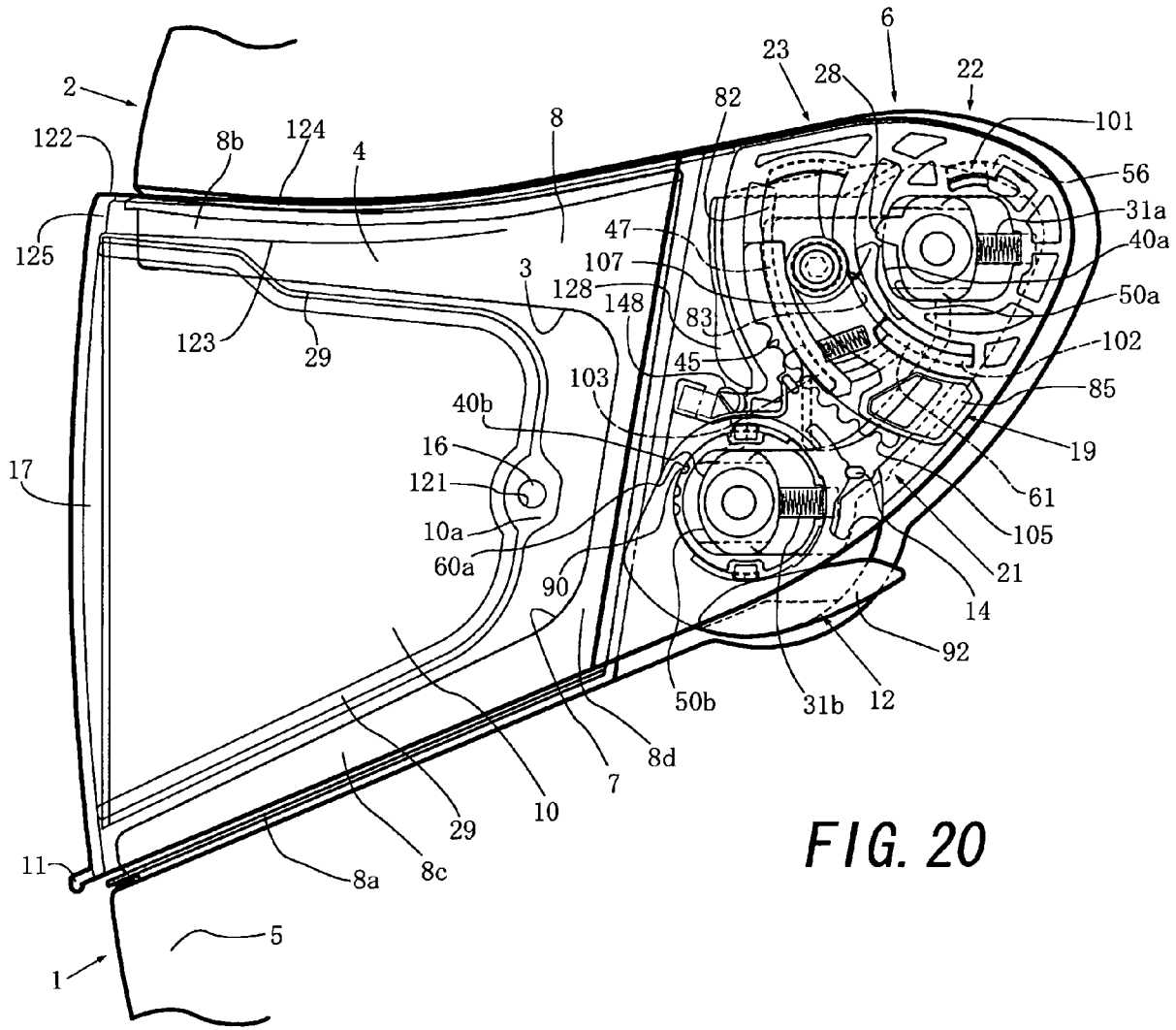
FIG. 20 is an enlarged left side view, similar to FIG. 16, of a state wherein a shield lock manipulation lever serving also as a shield slightly-opening manipulation lever is pivoted forward in a slightly-opening direction.
Figure 21:
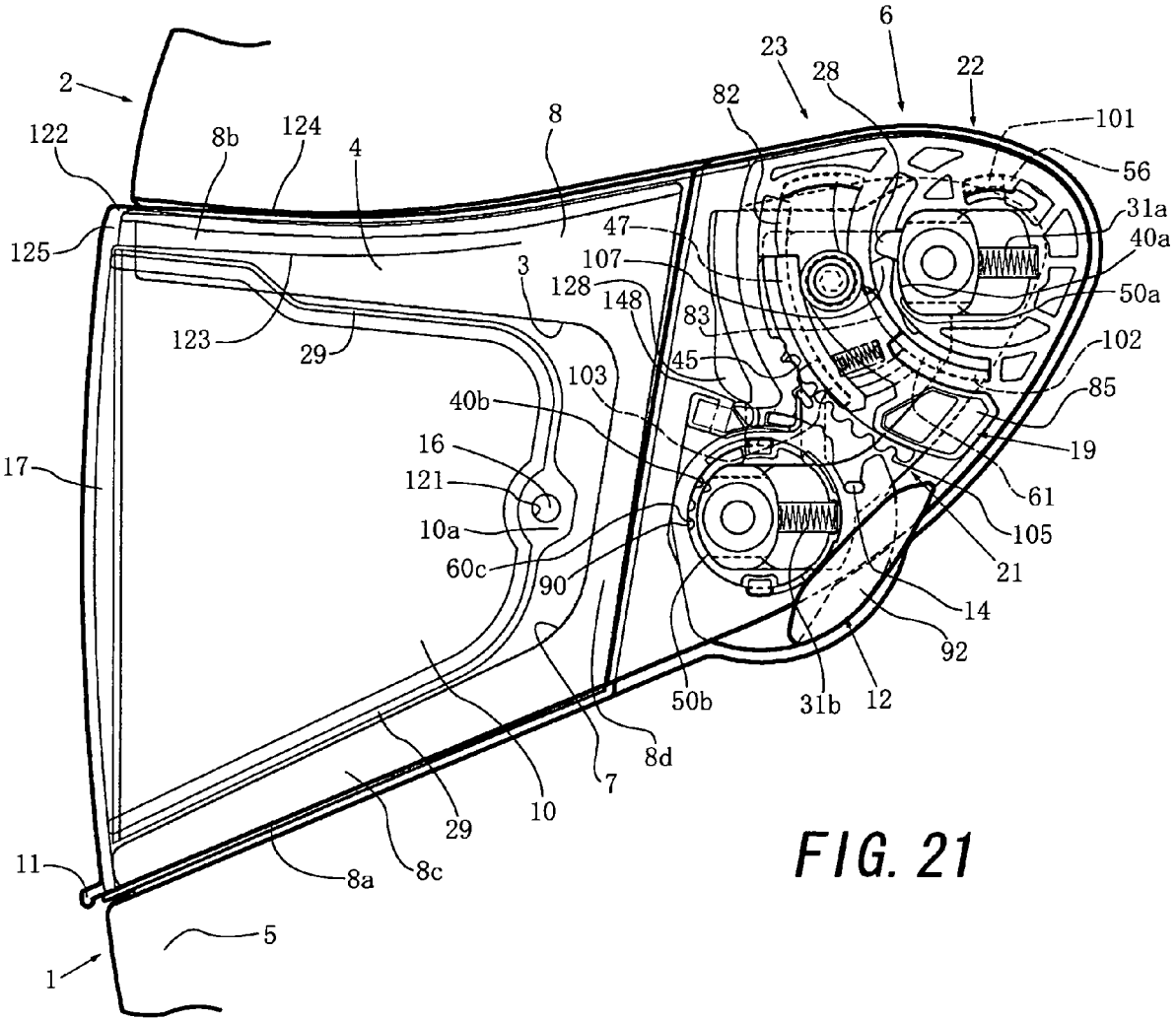
FIG. 21 is an enlarged left side view, similar to FIG. 16, of a state wherein the shield lock manipulation lever serving also as the shield slightly-opening manipulation lever is pivoted forward in a locking direction opposite to that of the case in FIG. 20.
Figure 22:
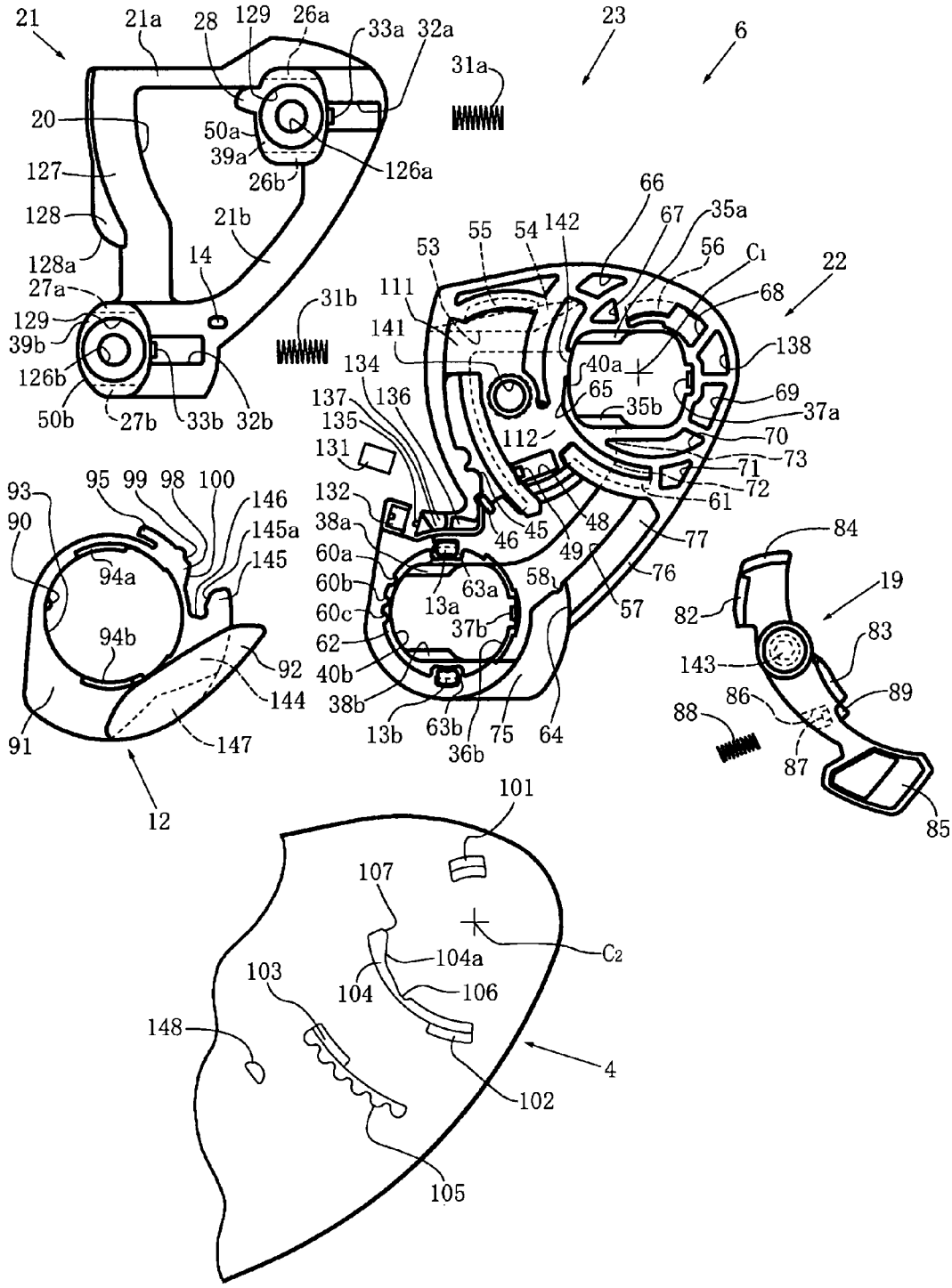
FIG. 22 is an exploded front view of the shield attaching mechanism in FIG. 15.

In FIGS. 15 to 23 which show the second embodiment, male screw members 24*a* and 24*b* identical to those of the first embodiment are not shown. FIGS. 15 to 23 show only a pair of screw insertion holes 126*a* and 126*b* formed in a stationary base member 21 where the male screw members 24*a* and 24*b* are to be inserted. In FIG. 22, reference numerals 129 denote ring-like recesses to accommodate the heads of the male screw members 24*a* and 24*b*. In the second embodiment, a pair of upper and lower notches 34*a* and 34*b* are not necessary and are accordingly omitted in the stationary base member 21. A front arm 127 of the stationary base member 21 has a curved cam surface portion 128. The front arm 127 projects from the inner surface toward the outer surface along the front edge to form the curved cam surface portion 128. The front edge of the curved cam surface portion 128 forms a cam surface 128*a*.

(2) Movable Base Member

In place of the substantially inverted-L-shaped leaf spring 43 (including the first and second spring portions 43*a* and 43*b*) employed by the movable base member 22 in the first embodiment described above, the second embodiment employs a blockish elastic body 131, as shown in FIG. 22, which exhibits rubber elasticity at room temperature. Accordingly, in the second embodiment, the substantially inverted-L-shaped groove 42 (including the first and second groove portions 42*a* and 42*b*) is also omitted in a movable base member 22. The blockish elastic body 131 can be made of elastomer such as natural rubber or synthetic rubber. The blockish elastic body 131 can have an arbitrary blockish shape such as a substantially cylindrical shape or substantially rectangular parallelepiped shape.

As shown in FIG. 22, the movable base member 22 has an elastic body accommodating recess 132 at a portion slightly in front of and slightly above an axial support 62. The elastic body accommodating recess 132 has an elastic body engaging projection 133 on its front side wall. The distal end of an engaging arm 41 slightly extends to the front side in substantially the horizontal direction to form a horizontal arm 134. The horizontal arm 134 has an elastic body engaging projection 135 at its front end. The front half of the blockish elastic body 131 is accommodated in the elastic body accommodating recess 132, and the pair of front and rear elastic body engaging projections 133 and 135 are fitted in a pair of front and rear engaging holes (not shown) respectively formed in the front and rear end faces of the blockish elastic body 131, to attach the blockish elastic body 131 to the movable base member 22 and hold it there. Accordingly, the blockish elastic body 131 elastically inhibits the engaging arm 41 from pivoting to the front side about its proximal end as the fulcrum. The horizontal arm 134 has a shield lock recess 136 serving as a shield lock engaged portion and a relief recess 137 to range from its proximal end side to its distal end side. The second embodiment employs the blockish elastic body 131, as described above, in place of the leaf spring 43 in the first embodiment. In the first embodiment, when, e.g., opening and closing the shield 4, as the engaging arm 41 (and accordingly the leaf spring 43) of the movable base member 22 vibrates, it may generate wiry noise (that is, wiry noise accompanying the vibration of the leaf spring 43). Second embodiment is free from the problem of wiry noise. Such wiry noise in the first embodiment tends to occur, in opening and closing the shield 4, when the click tooth portion 105 of the shield 4 rides over the click tooth portion 45 of the engaging arm 41 and the engaging state between the click tooth portions 105 and 45 changes to cause the engaging arm 41 (and accordingly the leaf spring 43) to vibrate.

In the second embodiment, as shown in FIG. 22, a substantially arcuate second guide 56 is provided at a position on a slightly more front side than in the case of the first embodiment. This forms a new recess 138 between recesses 68 and 69. Another recess 139 is formed slightly above the substantially arcuate guide 55. In the second embodiment, a through hole 141 is provided in place of the female screw member 51 and screw hole 52 in the first embodiment. Furthermore, in the second embodiment, a notch 142 is formed in place of the through hole 74 in the first embodiment.

(3) Shield Attaching/Removing Manipulation Lever

As shown in FIG. 22, the second embodiment employs an axial support member 143 in place of the male screw member 81 employed by the shield attaching/removing manipulation lever 19 in the first embodiment. The axial support member 143 projects toward the inner surface of a shield attaching/removing manipulation lever 19, and has a screw hole at its distal end and a coming-off preventive head at its proximal end. The axial support member 143 is inserted in the through hole 141 of the movable base member 22 from its distal end side and is pivotally fitted in the through hole 141. A male screw member (not shown) is screwed in the screw hole of the axial support member 143 through a coming-off preventive washer (not shown).

(4) Shield Lock Manipulation Lever Serving Also as Shield Slightly-Opening Manipulation Lever In the second embodiment, as shown in FIG. 22, a finger rest 92 of the shield lock manipulation lever 12 serving also as the shield slightly-opening manipulation lever integrally connects to a pivotal ring 91 at its portion 147 substantially below a virtual center line extending in the longitudinal direction of the finger rest 92. A relief slit 144 is formed, between the finger rest 92 and pivotal ring 91, at a portion substantially above the center line. In the fully-closed state shown in FIG. 16, the slightly-open state shown in FIG. 20 and the locked state shown in FIG. 21, the lower end of the shield 4 is partly inserted in the relief slit 144.

As shown in FIG. 22, near the upper end of the pivotal ring 91, a click notch 99 is formed to be adjacent to the front side of a cam projection 98 having an outer surface serving as a cam surface 100. Obliquely above a portion near the upper end of the pivotal ring 91, a shield lock projection 96 serving as a shield lock engaging portion projects obliquely to the front side, to be adjacent to the front side of the click notch 99. Near the rear end of the pivotal ring 91, a position regulating projection 145 is formed to oppose the cam projection 98 from behind. Hence, the pivotal ring 91 has an engaging notch 146 between the position regulating projection 145 and cam projection 98.

(5) Shield

In the second embodiment, as shown in FIG. 22, a substantially arcuate first guided portion 101 is disposed substantially above a common central point $C_2$ in the fully-closed state shown in FIG. 16, unlike in the case of the first embodiment. The second embodiment is provided with a cam projection 148, which serves as a cam follower, in place of the shield lock projection 15 provided in the first embodiment. The cam projection 148 is substantially semicylindrical, and its semicylindrical surface substantially opposes the common central point $C_2$. A first cam surface 104*a* formed on the shield 4 and a first cam follower 28 provided to the stationary base member 21 constitute the first cam mechanism. In contrast to this, the second cam surface 128*a* formed on the stationary base member 21 and the second cam follower 148 provided to the shield 4 constitute the second cam mechanism.

(6) Assembly of Shield Attaching Mechanism

Figure 19:
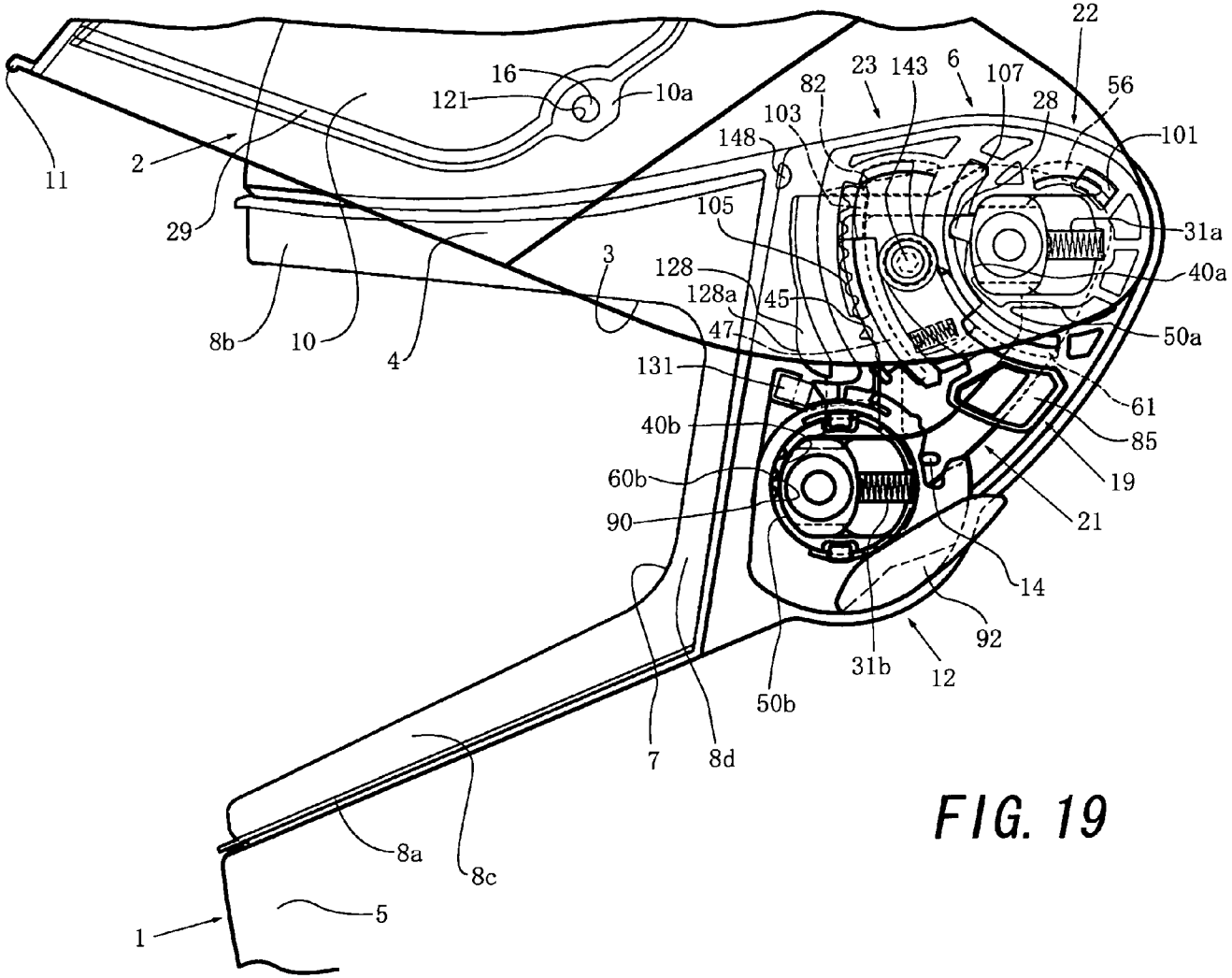
FIG. 19 is an enlarged left side view similar to FIG. 16, in which the shield is in a fully-open state.

When attaching the movable base member 22 to the stationary base member 21, in the first embodiment, the cam follower 28 of the stationary base member 21 shown in FIG. 9 is inserted in the through hole 74 of the movable base member 22. In the second embodiment, the cam follower 28 of the stationary base member 21 shown in FIG. 22 is inserted in the notch 142 of the movable base member 22. In the first embodiment, the male screw member 81 pivotally, axially supports the shield attaching/removing manipulation lever 19 onto the movable base member 22. In the second embodiment, a male screw member (not shown) is screwed into a screw hole (not shown) formed in the distal end of the axial support member 143 through a coming-off preventive washer (not shown), to pivotally, axially support a shield attaching/removing manipulation lever 19 onto the movable base member 22. Therefore, the manipulation lever 19 can pivot forward clockwise and counterclockwise in FIG. 16 about the axial support member 143 as the fulcrum. When the shield 4 attaches to the movable base member 22 and is in the fully-opened state, the second cam projection 148 provided to the shield 4 is spaced apart substantially upward from the cam surface 128*a* formed on the stationary base member 21, as shown in FIG. 19.

3. Operation of Shield Attaching Mechanism

The operation of the shield attaching mechanism will be described in "(1) fully-closed state", "(2) stage-1 open state", "(3) stage-4 open stage", "(4) fully-open state", "(5) removable state", "(6) slightly-open state" and "(7) locked state" with reference to FIGS. 15 to 23.

(1) Fully-Closed State

In the fully-closed state shown in FIG. 16 of the second embodiment, as the engaging projecting ridge 124 of the window opening rim member 8 engages with the engaging projecting ridge 122 of the shield 4, the mutual tight contact state between the engaging projecting ridge 124 and engaging projecting ridge 122 is very well. The second cam projection 148 of the shield 4 abuts against the cam surface 128*a* of the second curved cam surface portion 128 of the stationary base member 21, or is located in front of the cam surface 128*a* to be close to it. In the fully-closed state shown in FIG. 16, as a shield lock manipulation lever 12 serving also as a shield slightly-opening manipulation lever is at a neutral position, a shield slightly-opening projection 14 of the stationary base member 21 does not engage with the engaging notch 146 of the manipulation lever 12. Also, a shield lock projection 95 of the manipulation lever 12 is not inserted in the shield lock recess 136 of the movable base member 22. The cam projection 148 of the shield 4 enters the relief recess 137 of the movable base member 22.

(2) Stage-1 Open State

Figure 17:
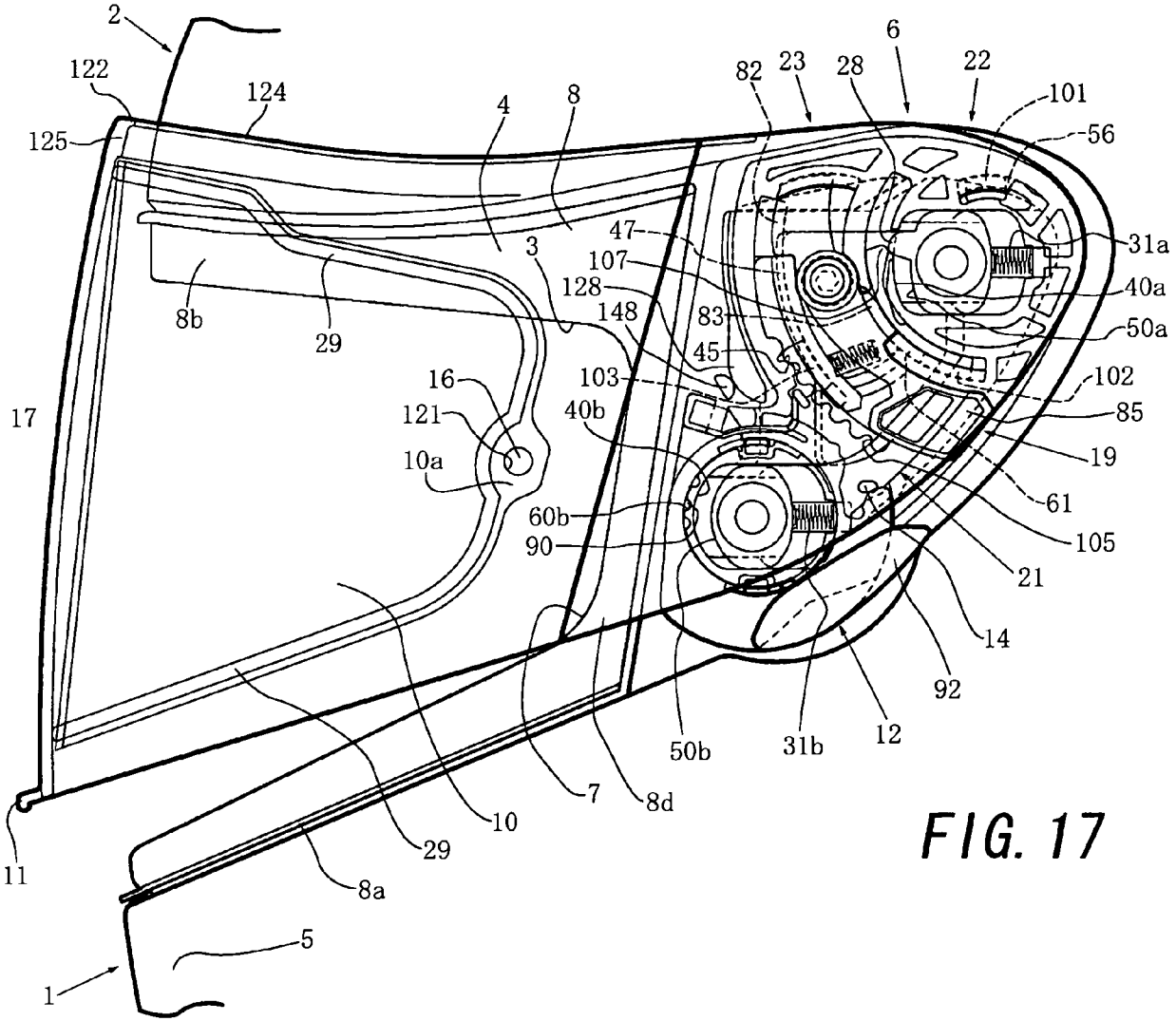
FIG. 17 is an enlarged left side view similar to FIG. 16, in which the shield is in a stage-1 open state.
Figure 23:
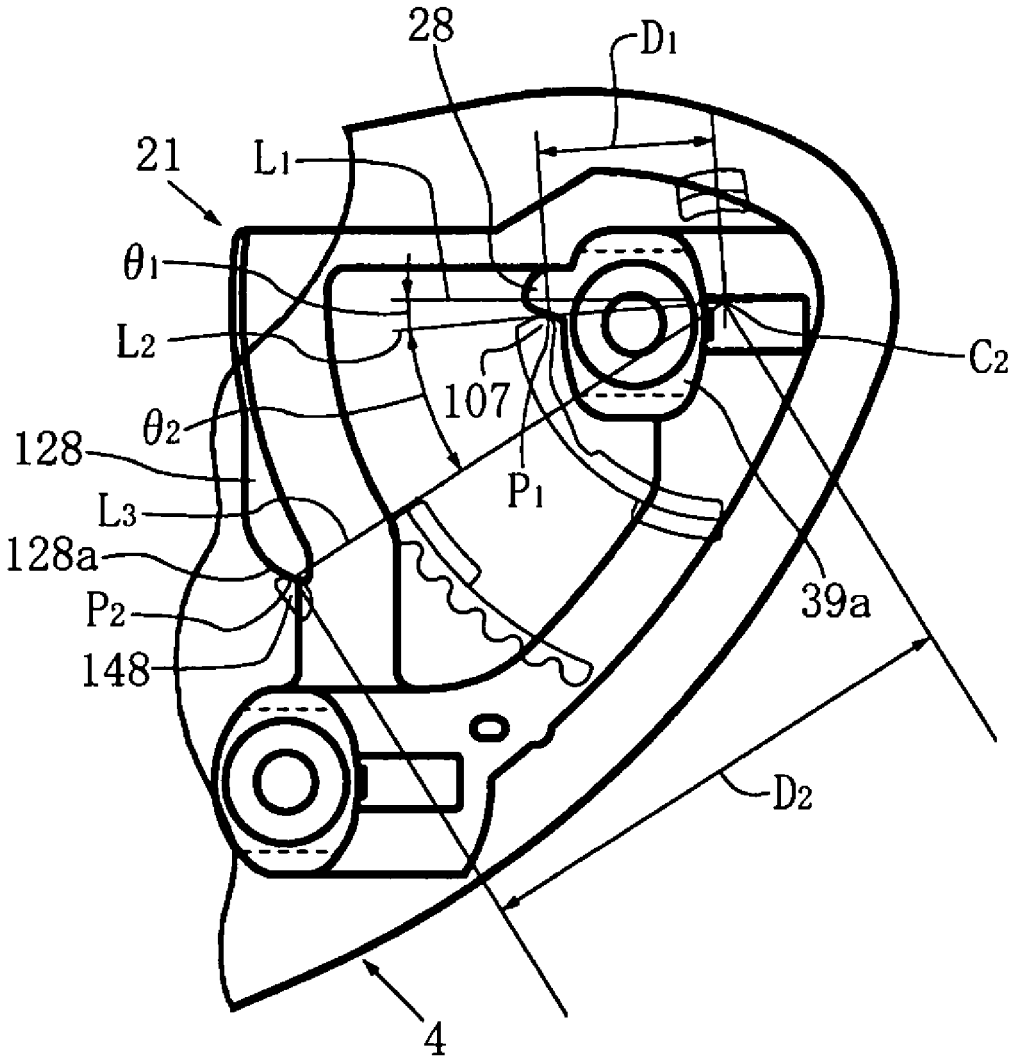
FIG. 23 is an enlarged side view of the main part of the helmet showing the mutual positional relationship between the stationary base member and shield in the fully-closed state shown in FIG. 16.

In the second embodiment, when the shield 4 in the fully-closed state shown in FIG. 16 is to be set in the stage-1 open state shown in FIG. 17, a first cam projection 107 of a curved cam surface portion 104 of the shield 4 pivots clockwise, as it is pushed out forward by the first cam follower 28 of the stationary base member 21, and rides over the first cam follower 28. Simultaneously, a second cam projection (in other words, a cam follower) 148 of the shield 4 pivots clockwise, as it is pushed out forward by the second curved cam surface portion 128 of the stationary base member 21, and rides over the second cam follower 148. Hence, as shown in FIG. 23, the stationary base member 21 relatively presses the shield 4 to the front side through a portion $P_1$ where the first cam projection 107 abuts against the first cam follower 28 and a portion $P_2$ where the second cam projection 148 abuts against the second curved cam surface portion 128. Hence, the shield 4 is pushed out to the front side more smoothly than in the first embodiment.

FIG. 23 shows the mutual positional relationship between the stationary base member 21 and shield 4 in the fully-closed state shown in FIG. 16 or a quasi-fully-closed state. In FIG. 23, reference symbol $\theta_2$ denotes an angle formed by a straight line $L_1$ and a straight line $L_3$ which connects the common central point $C_2$ and the contact portion $P_2$. Reference symbol $D_2$ denotes a distance between the common central point $C_2$ and contact portion $P_2$.

In FIG. 23, an angle $\theta_1$ is about 4°, and the distance $L_1$ is about 15.5 mm. Generally, from the viewpoint of practicability, the angle $\theta_1$ and a distance $D_1$ satisfy preferably at least one of the numerical ranges described in items (a) and (b) of item A3(2), and more preferably at least one of the numerical ranges in the parentheses of items (a) and (b). In FIG. 23, the angle $\theta_2$ is about 34°, and a distance $L_2$ is about 50 mm. Generally, from the viewpoint of practicability, the angle $\theta_2$ and distance $D_2$ satisfy preferably at least one of the numerical ranges of the angle $\theta_1$ and distance $D_1$ described in items (a) and (b) of item A3(2), and more preferably at least one of the numerical ranges in the parentheses of items (a) and (b). In FIG. 23, an angle $(\theta_2-\theta_1)$ is about 30°, and a distance $(D_2-D_1)$ is about 34.5 mm. Generally, from the viewpoint of practicability, the respective values or absolute values of the angle $(\theta_2-\theta_1)$ and distance $(D_2-D_1)$ satisfy preferably at least one of the numerical ranges described in the following items (a) and (b). The numerical ranges in the parentheses of items (a) and (b) indicate numerical ranges that should be satisfied more preferably.

(a) angle $(\theta_2-\theta_1)$: numerical range of 5° to 55° (15° to 45°) and (b) distance $(D_2-D_1)$: numerical range of 5 mm to 65 mm (20 mm to 50 mm)

(3) Stage-4 Open State

Figure 18:
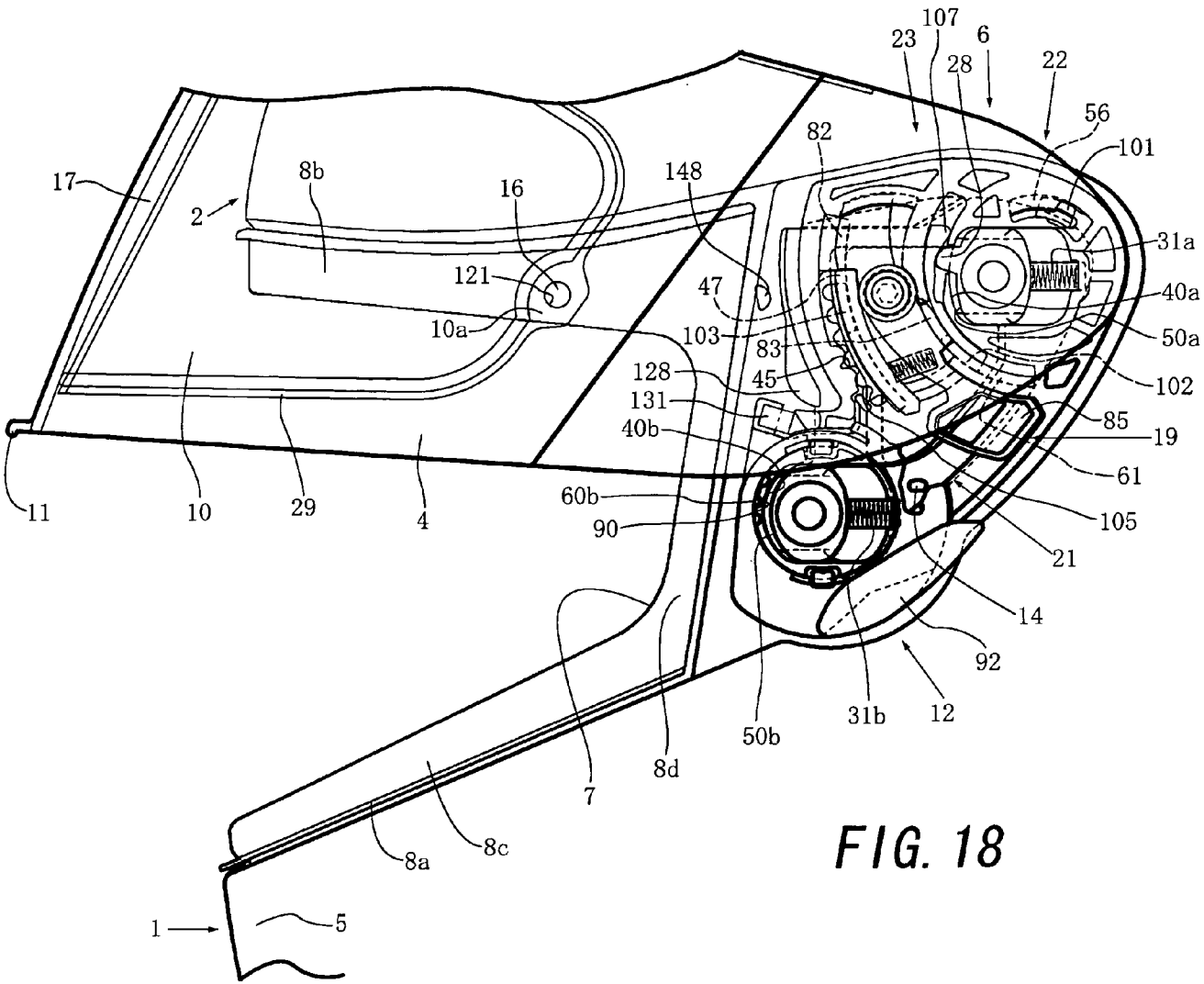
FIG. 18 is an enlarged left side view similar to FIG. 16, in which the shield is in a stage-4 open state.

In the second embodiment, when the shield 4 in the stage-1 open state shown in FIG. 17 shifts to the stage-4 open state shown in FIG. 18, at a portion slightly below the first cam projection 107 of the curved cam surface portion 104, the first cam surface 104*a* of the curved cam surface portion 104 of the shield 4 abuts against the first cam follower 28 of the stationary base member 21, in the same manner as in the first embodiment. Simultaneously, the second cam projection 148 of the shield 4 gradually separates from the cam surface 128*a* of the second curved cam surface portion 128, as shown in FIG. 18. Therefore, after this separation, the mutual contact state of the first cam surface 104*a* of the shield 4 and the first cam follower 28 of the stationary base member 21 determines the push-out position of the shield 4 to the front side, in the same manner as in the first embodiment.

(4) Fully-Open State

In the fully-open state in the second embodiment, the second cam projection 148 of the shield 4 is spaced apart substantially upward from the second cam surface 128*a* of the stationary base member 21, as shown in FIG. 19.

(5) Removable State

In the second embodiment, the shield attaching/removing manipulation lever 19 pivots forward clockwise in FIG. 19 about the axial support member 143 as the fulcrum.

(6) Slightly-Open State

In the fully-closed state shown in FIG. 16, when pivoting the shield lock manipulation lever 12 serving also as the shield slightly-opening manipulation lever forward clockwise in FIG. 16 (that is, in the first forward pivot direction), the slightly-open state shown in FIG. 20 is obtained. In the slightly-open state, the shield slightly-opening projection 14 of the stationary base member 21 moves relatively along a cam surface 100 of the manipulation lever 12 to ride over a cam projection 98. This moves the manipulation lever 12, together with the movable base member 22, linearly forward to the front side with respect to the stationary base member 21. When pivoting the manipulation lever 12 further forward in the first forward pivot direction, one end of the shield slightly-opening projection 14 of the stationary base member 21 relatively fits in the click notch 99 of the manipulation lever 12.

(7) Locked State

In the fully-closed state shown in FIG. 16, when pivoting the shield lock manipulation lever 12 serving also as the shield slightly-opening manipulation lever forward counter-clockwise in FIG. 16 (that is, in the second forward pivot direction), the shield-locked state shown in FIG. 21 is obtained. The forward pivot motion of the manipulation lever 12 inserts the shield lock projection 95 of the manipulation lever 12 in the shield lock recess 136 of the movable base member 22 to engage them with each other. This inhibits the engaging arm 41 of the movable base member 22 from pivoting forward clockwise in FIG. 21 about its proximal end as the fulcrum, and firmly holds the engaging arm 41 at the backward pivot position shown in FIG. 21. As the click tooth portion 45 of the engaging arm 41 inhibits the click tooth portion 105 of the shield 4 from pivoting forward clockwise in FIG. 21 about the common central point $C_2$ as the fulcrum, the shield 4 is held (that is, locked) in the fully-closed state until the above engagement is canceled. The above forward pivot motion of the manipulation lever 12 causes the cam follower (in other words, the shield slightly-opening projection) 14 of the stationary base member 21 to relatively enter the engaging notch 146 of the manipulation lever 12 to engage it with the engaging notch 146. At this time, even if the manipulation lever 12 (and accordingly the movable base member 22 and shield 4) may have been pushed out slightly to the front side, the cam follower 14 relatively abuts against an inclined surface (that is, an inclined surface on the engaging notch 146 side) 145*a* of the position regulating projection 145 of the manipulation lever 12, and then relatively enters the engaging notch 146. This abutment retracts the manipulation lever 12 (and accordingly the movable base member 22 and shield 4) to the rear side, so the shield 4 comes into good tight contact with the window opening rim member 8. This shield-locked state can be similarly attained in the case of the fully-open state shown in FIG. 19 or the like (that is, cases other than the fully-closed state).

Having described specific preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

For example, in the first and second embodiments, the present invention is applied to a full-face-type helmet. The present invention can also be applied to a full-face-type helmet serving also as a jet-type helmet in which the chin cover can move upward, a jet-type helmet, a semi-jet-type helmet, and the like.

The first embodiment is provided with one cam surface 104*a* and one cam follower 28. The second embodiment is provided with the two cam surfaces 104*a* and 128*a*, and the two cam followers 28 and 148. Alternatively, three or more cam surfaces and three or more cam followers can be provided.

In the first embodiment, the cam surface 104*a* is formed on the shield 4, and the cam follower 28 which opposes the cam surface 104*a* is provided to the stationary base member 21. Alternatively, a cam surface may be formed on the stationary base member 21, and a cam follower which opposes the cam surface may be provided to the shield 4.

In the second embodiment, the first cam surface 104*a* and second cam follower 148 are provided to the shield 4, and the first cam follower 28 and second cam surface 128*a* which respectively oppose the first cam surface 104*a* and second cam follower 148 are provided to the stationary base member 21. Alternatively, both the first and second cam surfaces may be formed on any one of the shield 4 and stationary base member 21, and both the first and second cam followers which respectively oppose the first and second cam surfaces may be provided to the remaining one of the stationary base member 21 and shield 4.

In the first and second embodiments, the first and second stoppers 50*a* and 50*b* are provided to the stationary base member 21, and the first and second stopped portions 40*a* and 40*b* respectively opposing the first and second stoppers 50*a* and 50*b* are provided to the movable base member 22. Alternatively, one, or three or more stoppers may be provided to the stationary base member 21, and one, or three or more stopped portions which respectively oppose the stoppers may be provided to the movable base member 22.

The first and second embodiments employ the compression coil springs 31*a*, 31*b* and 88 as elastic biasing means or elastic biasing members. Alternatively, of the three elastic biasing means 31*a*, 31*b* and 88, one, two, or three may comprise tension coil springs, or springs other than coil springs, e.g., leaf springs.

In the first and second embodiments, each of the shield attaching/removing manipulation member 19 and the shield lock manipulation member 12 which serves also as the shield slightly-opening manipulation member comprises a reciprocally pivotal manipulation lever. Alternatively, each of the manipulation members 19 and 12 can comprise a linearly reciprocal member, or a member capable of reciprocal movement other than reciprocal pivot motion or linear reciprocal movement.

I claim:

1. A helmet shield attaching mechanism comprising a shield attaching base member attaching to a head protecting body, and a shield, a portion near one of right and left ends of which pivotally attaches to said shield attaching base member, said shield attaching base member comprising a stationary base member fixing to said head protecting body, and a movable base member attaching to said stationary base member so as to be linearly reciprocally movable with respect to said stationary base member, and said shield being pivotally supported by said movable base member, wherein any one of said shield and said stationary base member is provided with at least one cam surface, the remaining one of said shield and said stationary base member is provided with at least one cam follower to be able to abut against said at least one cam surface, and when a substantially upward force acts on said shield which is in a substantially fully-closed state, said cam follower relatively follows said cam surface to move said shield, together with said movable base member, forward substantially to a front side with respect to said stationary base member, further comprising at least one elastic biasing means capable of elastically biasing said movable base member toward said stationary base member substantially to a rear side, at least one stopper provided to said stationary base member, and at least one stopped portion provided to said movable base member, wherein when said elastic biasing means elastically biases said movable base member and holds said movable base member at a backward position, said at least one stopped portion abuts against said at least one stopper, and said elastic biasing means comprises a compression coil spring.

2. A helmet shield attaching mechanism comprising a shield attaching base member attaching to a head protecting body, and a shield, a portion near one of right and left ends of which pivotally attaches to said shield attaching base member, said shield attaching base member comprising a stationary base member fixing to said head protecting body, and a movable base member attaching to said stationary base member so as to be linearly reciprocally movable with respect to said stationary base member, and said shield being pivotally supported by said movable base member, wherein any one of said shield and said stationary base member is provided with at least one cam surface, the remaining one of said shield and said stationary base member is provided with at least one cam follower to be able to abut against said at least one cam surface, and when a substantially upward force acts on said shield which is in a substantially fully-closed state, said cam follower relatively follows said cam surface to move said shield, together with said movable base member, forward substantially to a front side with respect to said stationary base member, further comprising at least one elastic biasing means capable of elastically biasing said movable base member toward said stationary base member substantially to a rear side, at least one stopper provided to said stationary base member, and at least one stopped portion provided to said movable base member, wherein when said elastic biasing means elastically biases said movable base member and holds said movable base member at a backward position, said at least one stopped portion abuts against said at least one stopper, and when said shield is pivoted forward to the substantially full-open state, said stopped portion abuts against said stopper.

3. A helmet shield attaching mechanism comprising a shield attaching base member attaching to a head protecting body, and a shield, a portion near one of right and left ends of which pivotally attaches to said shield attaching base member, said shield attaching base member comprising a stationary base member fixing to said head protecting body, and a movable base member attaching to said stationary base member so as to be linearly reciprocally movable with respect to said stationary base member, and said shield being pivotally supported by said movable base member, wherein any one of said shield and said stationary base member is provided with at least one cam surface, the remaining one of said shield and said stationary base member is provided with at least one cam follower to be able to abut against said at least one cam surface, when a substantially upward force acts on said shield which is in a substantially fully-closed state, said cam follower relatively follows said cam surface to move said shield, together with said movable base member, forward substantially to a front side with respect to said stationary base member, a reciprocal shield lock manipulation member serving also as a shield slightly-opening manipulation member, which is capable of setting said shield in a slightly-open state and in a locked state at a substantially fully-closed position, is disposed to be reciprocal with respect to said movable base member, when moving said shield lock manipulation member serving also as said shield slightly-opening manipulation member forward in a first forward direction from a neutral position, said shield can be set in a slightly-open state, and when moving said shield lock manipulation member serving also as said shield slightly-opening manipulation member forward in a second forward direction from the neutral position, said shield can be set in a locked state.

4. A mechanism according to claim 3, wherein said shield lock manipulation member serving also as said shield slightly-opening manipulation member is reciprocally pivotal about an axial support as a fulcrum.

* * * * *